US010640957B2

(12) United States Patent
Birmelin

(10) Patent No.: US 10,640,957 B2
(45) Date of Patent: May 5, 2020

(54) JET REGULATOR

(71) Applicant: Neoperl GmbH, Mullheim (DE)

(72) Inventor: David Birmelin, Mullheim (DE)

(73) Assignee: NEOPERL GMBH, Mullheim (DE)

( * ) Notice: Subject to any disclaimer, the term of this patent is extended or adjusted under 35 U.S.C. 154(b) by 217 days.

(21) Appl. No.: 15/548,936

(22) PCT Filed: Feb. 17, 2016

(86) PCT No.: PCT/EP2016/000268
§ 371 (c)(1),
(2) Date: Aug. 4, 2017

(87) PCT Pub. No.: WO2016/138981
PCT Pub. Date: Sep. 9, 2016

(65) Prior Publication Data

US 2018/0038085 A1 Feb. 8, 2018

(30) Foreign Application Priority Data

Mar. 5, 2015 (DE) ..... 20 2015 001 686 U
Nov. 14, 2015 (DE) ..... 20 2015 007 873 U

(51) Int. Cl.
*E03C 1/084* (2006.01)
*B05B 1/16* (2006.01)
*B05B 7/04* (2006.01)

(52) U.S. Cl.
CPC ..... *E03C 1/084* (2013.01); *B05B 1/1654* (2013.01); *B05B 7/04* (2013.01); *B05B 7/0425* (2013.01)

(58) Field of Classification Search
CPC ..... E03C 1/08; B05B 7/0425; B05B 1/12; B05B 1/1654; B05B 1/1645; B05B 1/1636

(Continued)

(56) References Cited

U.S. PATENT DOCUMENTS 3,334,818 A 8/1967 Moen
7,017,837 B2 3/2006 Taketomi et al.

(Continued)

FOREIGN PATENT DOCUMENTS

DE 202013002054 5/2013
EP 1443151 8/2004

(Continued)

*Primary Examiner* — Jason J Boeckmann
(74) *Attorney, Agent, or Firm* — Volpe and Koenig, P.C.

(57) ABSTRACT

The present invention relates to a jet regulator (2) has a jet regulator housing with at least two housing parts (5, 6) which are rotatable relative to one another and of which an inflow-side first housing part (5) is mountable in a rotationally fixed manner on the water outlet of a sanitary outlet fitting and of which an outflow-side second housing part (6), at least at its outflow-side housing outer circumference, is configured as a handle or is connected to a handle, wherein the first housing part (5) has a jet splitter (7) having a plurality of splitter openings (8), wherein spaced-apart jet ducts (9) are provided on the housing inner circumference of the second housing part (6), and wherein the individual jets coming from the splitter openings (8) are guided through the jet ducts (9) and formed into an annularly circumferential outlet jet pattern in a first rotary position of the housing parts (5, 6), and are deflected in the housing interior of the jet regulator (2) to a central outlet opening (10) in the jet regulator housing in a second rotary position. The jet regulator according to the invention is characterized in that a rotary latch having at least one latching tooth (13) is provided, said latching tooth (13) being integrally formed on a duct wall facing the housing interior of the jet regulator housing and said latching tooth (13) interacting with a latching profile, and in that a lattice or grid structure that extends over the central outlet opening (10) is integrally formed on the outflow side of the second housing part (6).

38 Claims, 23 Drawing Sheets

(58) Field of Classification Search
USPC ..... 239/428.5, 445–449
See application file for complete search history.

(56) References Cited

U.S. PATENT DOCUMENTS

| | | | | |
|---|---|---|---|---|
| 9,205,436 | B2 * | 12/2015 | Zhou | B05B 7/0425 |
| 2006/0163387 | A1 | 7/2006 | Erdely | |
| 2014/0217202 | A1 | 8/2014 | Stein et al. | |
| 2014/0300010 | A1 * | 10/2014 | Zhou | B05B 7/0425 261/78.2 |

FOREIGN PATENT DOCUMENTS

| | | |
|---|---|---|
| EP | 2762234 | 8/2014 |
| WO | 2011047134 | 4/2011 |
| WO | 2012095238 | 7/2012 |

* cited by examiner

JET REGULATOR

BACKGROUND

The present invention relates to a jet regulator which is switchable optionally between at least two outlet jet patterns and which to this end has a jet regulator housing with at least two housing parts which are rotatable relative to one another and of which an inflow-side first housing part is mountable in a rotationally fixed manner on the water outlet of a sanitary outlet fitting and of which an outflow-side second housing part, at least at its outflow-side housing outer circumference, is configured as a handle or is connected to a handle, wherein the first housing part has a jet splitter having a plurality of splitter openings, wherein spaced-apart jet ducts are provided on the housing inner circumference of the second housing part, wherein the individual jets coming from the splitter openings are guided through the jet ducts and formed into an annularly circumferential outlet jet pattern in a first rotary position of the housing parts, and are deflected in the housing interior of the jet regulator to a central outlet opening in the jet regulator housing in a second rotary position, wherein a rotary latch having at least one latching tooth is provided between the first and the second housing part, said latching tooth being integrally formed on a duct wall, facing the housing interior of the jet regulator housing, of at least one jet duct and said latching tooth interacting with a latching profile which is arranged on a circumferential wall of the first housing part, wherein at least one subregion, bearing the latching tooth, of the duct wall of the at least one jet duct or at least a subregion of the wall, bearing the latching profile, of the first housing part is configured as a flexible tongue, and wherein a lattice or grid structure that extends over the central outlet opening is integrally formed on the outflow side of the second housing part.

US 2014/0300010 A1 has already disclosed a sanitary insert unit of the type mentioned in the introduction which is insertable into a sleeve-like outlet mouthpiece in order to thereby be able to be installed on the water outlet of a sanitary outlet fitting. The known insert unit has an inflow-side attachment or filter screen for filtering out any dirt particles entrained in the inflowing water, and has an outflow-side jet regulator of the type mentioned in the introduction, which is switchable manually between two outlet jet patterns. Whereas one outlet jet pattern provides a spray jet formed by a number of individual jets, the other outlet jet pattern of the known jet regulator constitutes a relatively voluminous, aerated outlet jet. In the known insert unit, a flow rate regulator is provided between the inflow-side attachment or filter screen and the outflow-side jet regulator, which flow rate regulator is intended to limit the water flow rate passing through to a maximum value per unit of time, which maximum value is also independent of the water pressure.

The known insert unit, and in particular its jet regulator which is switchable between two outlet jet patterns, are relatively cumbersome in terms of design and production. Furthermore, the outlet jet patterns generated in the known insert unit are still relatively disordered and unstable.

U.S. Pat. No. 7,017,837 B2 has disclosed a jet regulator which is likewise switchable between an aerated overall jet and a spray jet formed from a number of individual jets. Said known jet regulator is also relatively cumbersome in terms of its design and production.

The problem addressed is therefore in particular that of realizing a jet regulator of the type mentioned in the introduction which can be produced with relatively little outlay and which is distinguished by inherently stable outlet jet patterns which are clearly distinguishable from one another.

SUMMARY

A solution according to the invention to said problem provides, to this end, that the splitter openings of the jet splitter open into duct-like discharge ducts which are separated from one another in the circumferential direction by pocket-like cutouts in the outflow side of the jet splitter.

The jet regulator according to the invention, which is mountable on its own or as a constituent part of a sanitary insert unit on the water outlet of a sanitary outlet fitting, is switchable between at least two outlet jet patterns. To this end, the jet regulator according to the invention has a jet regulator housing with at least two housing parts which are rotatable relative to one another. Whereas an inflow-side first housing part is mountable in a rotationally fixed manner on the water outlet of a sanitary outlet fitting, an outflow-side second housing part, at least at its outflow-side housing outer circumference, is configured as a handle or is connected to a handle, in order that the second housing part can be gripped there and rotated relative to the first housing part. The first housing part has a jet splitter which has a plurality of splitter openings in which the inflowing water is divided up into a corresponding number of individual jets. Spaced-apart jet ducts are provided on the housing inner circumference of the second housing part, wherein the individual jets coming from the splitter openings are guided through the jet ducts and formed into an annularly circumferential outlet jet pattern in a first rotary position of the housing parts, whereas the individual jets coming from the splitter openings are deflected in the housing interior of the jet regulator to a central outlet opening in the jet regulator housing in a second rotary position. To be able to choose and differentiate between the outlet jet patterns, a rotary latch is provided between the first and the second housing part. Said rotary latch has at least one latching tooth which is integrally formed on a duct wall, facing the housing interior of the jet regulator housing, of at least one of the jet ducts. The at least one latching tooth interacts with a latching profile which is arranged on a circumferential wall of the first housing part. The housing parts of the jet regulator according to the invention can thus be oriented relative to one another in an exact manner, such that the flow paths in the housing interior of the jet regulator housing that lead to a defined outlet jet pattern can be exactly adhered to. Here, a lattice or grid structure that extends over the central outlet opening is integrally formed on the outflow side of the second housing part. By means of said outlet-side lattice or grid structure, the water emerging via the central outlet opening can be shaped to form a homogeneous, non-sputtering overall jet. Since the at least one radially inwardly projecting latching tooth is integrally formed on a subregion, configured as a flexible tongue, of the duct wall of the at least one jet duct, it is also possible for the outflow-side second housing part to be easily produced as an injection-molded part and in particular as a plastics injection-molded part, wherein the at least one flexible tongue which bears a latching tooth can deflect during the demolding of the second housing part. It is however additionally or alternatively also possible for at least one subregion of the wall, bearing the latching profile, of the first housing part to be configured as a flexible tongue, which can likewise noticeably facilitate latching of the at least one latching tooth in the latching profile, wherein the rotary positions of the housing parts can be easily sensed by touch and are easily distinguishable from one another. In order, in the jet regulator according to the invention, to form inherently stable outlet jet patterns that are clearly distinguishable from one another, it is provided according to the invention that the splitter openings of the jet splitter open into duct-like discharge ducts which are separated from one another in the circumferential direction by pocket-like cutouts in the outflow side of the jet splitter. The jet regulator according to the invention is thus characterized by its simple producibility and by inherently stable outlet jet patterns which are clearly distinguishable from one another.

In order that each of the latching positions which correspond to an outlet jet pattern can be easily recognized during the manual rotation of the second housing part relative to the first housing part, it is advantageous if a latching cam is provided in each case at at least two, preferably at four, and in particular at all the jet ducts.

It may be advantageous if the annularly circumferential outlet jet pattern emerges from the jet regulator as an annular wall of water.

An embodiment of the invention is however preferable in which the annularly circumferential outlet jet pattern is formed by individual jets that are arranged orbitally and emerge from the jet regulator separately from one another. The individual jets arranged orbitally generate a spray jet. In order that the latching teeth possibly provided on a respective flexible tongue can easily deflect and rebound, it is advantageous if the flexible tongue of the at least one jet duct is separated on both sides from the adjacent duct side walls by wall incisions.

To be able to switch the jet regulator according to the invention from one outlet jet pattern to the other outlet jet pattern in a simple manner, without attention having to be paid to the direction of rotation, it is advantageous if the outlet jet pattern assigned to the first and the outlet jet pattern assigned to the second rotational position alternate with every latching position of the rotary latch. In this way, the second housing part can be rotated relative to the first housing part in one or the other direction of rotation, wherein the latching positions corresponding to a respective outlet jet pattern alternate.

To realize a smooth and nevertheless strong rotary latch between the housing parts, it is advantageous if the latching profile provided on the circumferential wall of the first housing part has latching cams which are arranged alongside one another in the circumferential direction and of which in each case two adjacent latching cams bound a latching indentation between one another. The at least one latching tooth of the rotary latch can easily latch into said latching indentations, whereby the corresponding rotary position is secured.

To improve the smoothness of said rotary latch, it may be advantageous if each subregion, bearing in each case one latching cam, of the wall is configured as a flexible tongue, and if wall incisions are provided between adjacent flexible tongues in the region of each latching indentation.

Here, secure and exact latching of the rotary latch in each individual latching position is promoted if the radii of the profile roundings and of the at least one latching tooth approximately correspond to one another.

Another solution to the above-stated problem relates to a jet regulator which is switchable optionally between at least two outlet jet patterns and which to this end has a jet regulator housing with at least two housing parts which are rotatable relative to one another and of which an inflow-side first housing part is mountable in a rotationally fixed manner on the water outlet of a sanitary outlet fitting and of which an outflow-side second housing part, at least at its outflow-side housing outer circumference, is configured as a handle or is connected to a handle, wherein the first housing part has a jet splitter having a plurality of splitter openings, wherein spaced-apart jet ducts are provided on the housing inner circumference of the second housing part, wherein the individual jets coming from the splitter openings are guided through the jet ducts and formed into an annularly circumferential outlet jet pattern in a first rotary position of the housing parts, and are deflected in the housing interior of the jet regulator to a central outlet opening in the jet regulator housing in a second rotary position, wherein the jet splitter has two jet splitter subregions, of which a central first jet splitter subregion is configured in a pot-like manner, wherein the central first jet splitter subregion is connected to a second jet splitter subregion that is configured as a circumferential annular flange or annular shoulder, and wherein the splitter openings are provided in the second jet splitter subregion.

In the case of the abovementioned jet regulator, the solution according to the invention to the problem stated in the introduction consists in that the pot-like jet splitter has, on the outflow side of its pot bottom, spaced-apart pins or pegs which form pin-like flow obstructions.

In this refining embodiment according to the invention, for which independent protection is also claimed, the jet splitter has two jet splitter subregions, of which a central first jet splitter subregion is configured as a pot-like calming zone, in which the influent water is slowed and is deflected, by means of the circumferential wall of said pot shape, in a radial direction to the second jet splitter subregion, wherein the second jet splitter subregion is configured as a circumferential annular flange or annular shoulder, in which the splitter openings of the jet splitter are provided. It is provided according to the invention that the pot-like jet splitter has, on the outflow side of its pot bottom, spaced-apart pins or pegs which form pin-like flow obstructions.

A stable and uniform outlet jet pattern is promoted if the splitter openings are arranged in a manner distributed regularly over the second jet splitter subregion.

A particularly good slowing action on the water flowing into the jet regulator according to the invention is promoted if the pot-like first jet splitter subregion is configured in a hole-free manner.

To further additionally reduce the low outlay in terms of design and production, it is advantageous if the jet splitter is connected integrally to the inflow-side first housing part.

A preferred embodiment according to the invention provides that the second housing part is configured in a sleeve-like manner at least in its inflow-side subregion.

In order to enable the first and the second housing part of the jet regulator housing to be easily rotated relative to one another and nevertheless securely connected to one another, it is advantageous if the first and the second housing part are connectable releasably together, and preferably latchable together.

A space-saving and compact design of the jet regulator according to the invention is promoted if the pot-like first jet splitter subregion protrudes into the sleeve interior of the second housing part.

By virtue of the two housing parts being rotated relative to one another, the splitter openings of the jet splitter provided in the first housing part are aligned, in terms of their relative position, with the duct openings of the jet ducts provided in the second housing part. Whereas it is the case in a latching position corresponding to the first rotary position that the splitter openings are arranged above the duct openings of the jet ducts, it is the case in the second rotary position of the housing parts that said splitter openings are aligned with the free space or longitudinal gap that remains between the jet ducts in the housing interior of the jet regulator housing. Here, the water that is conducted through the free spaces that remain between the jet ducts can be deflected into a central section in the housing interior of the jet regulator housing, in order, from there, to emerge as a possibly also aerated overall jet from the jet regulator housing.

In order to make it possible for the flow paths, assigned to a respective outlet jet pattern, in the housing interior of the jet regulator housing to be separated from one another without the need for said flow paths to be sealed off with respect to one another, it is advantageous if an internal sleeve is provided in the second housing part, the outlet end side of said internal sleeve forming the central outlet opening.

In order that the water flowing through the jet regulator according to the invention can, in the housing interior of the jet regulator housing, be guided into the central first jet regulator subregion in one of the rotary positions, it is advantageous if deflecting slopes are provided on the inner circumference of the second housing part, said deflecting slopes deflecting the individual jets formed in the splitter openings in the direction of the central outlet openings in at least a second rotary position of the housing parts.

A preferred embodiment according to the invention provides that at least one flow divider is provided on at least one deflecting slope, said at least one flow divider dividing the water flowing along the deflecting slope into part-flows. The flow dividers which are provided in at least one of the deflecting slopes, and preferably in all deflecting slopes, divide up the water flowing past them into in each case at least two part-flows, which are subsequently split up further at the flow obstructions situated downstream in the flow direction.

Here, it is particularly advantageous if the at least one flow divider protrudes in a fin-like manner over the at least one deflecting slope.

The water that is deflected by means of the deflecting slopes in the direction of the central first jet regulator subregion arrives there at a relatively high speed, which must then firstly be reduced before the water flowing through the jet regulator according to the invention can be shaped and modified in the desired manner. To slow the speed of the water arriving on the outflow side of the deflecting slopes, it is expedient if spaced-apart pin- or web-like flow obstructions are provided on the outflow side of the deflecting slopes.

Here, an advantageous embodiment according to the invention provides that the pot-like jet splitter has, on the outflow side of its pot bottom, spaced-apart pins or pegs which form pin-like flow obstructions. Since the pins or pegs provided on the outflow side of the jet splitter form pin-like flow obstructions, which the water coming from the deflecting slopes must wind its way through, the speed of the water is reduced in an effective manner between said pin-like obstructions.

Here, a preferred embodiment according to the invention provides that the pins or pegs preferably taper conically toward their outflow-side pin or peg end, and/or that the pin or peg end of the pins or pegs is rounded.

To further additionally reduce the speed of the water guided through the pins or pegs, it is advantageous if a central pot-bottom subregion protrudes from the outflow side of the pot bottom of the pot-like jet splitter, and/or if the pot bottom of the pot-like jet splitter is formed in a stepped manner at least on its outflow side.

In order that the jet regulator according to the invention can be of relatively compact form, it is advantageous if the pin or peg ends of the pins or pegs are arranged approximately in a plane.

Additional speed reduction of the water flowing through the housing interior of the jet regulator housing is achieved if at least one lattice or grid structure with webs that intersect at intersecting points is provided in the sleeve interior of the second housing part, below the deflecting slopes in the flow direction, which webs bound the throughflow holes between one another and are provided as web-like flow obstructions.

For the same purpose, it may be advantageous if at least one insert part which is configured as a lattice or grid structure or has a lattice or grid structure is insertable into the sleeve interior of the second housing part.

In order that, with the changes in rotational positions, the respective outflow jet patterns can also be changed, it is advantageous if in each case one deflecting slope is provided between adjacent jet ducts.

In order that the water deflected by means of the deflecting slopes can, on the outflow side of the jet splitter, pass the pin- or web-like flow obstructions provided there, it is advantageous if the at least one deflecting slope has a deflecting slope outlet which opens into the sleeve interior below the jet splitter.

To achieve an additional speed reduction of the water deflected in the jet regulator housing, it is advantageous if at least one of the deflecting slopes has at least one preferably flipper-like or fin-like flow divider in the region of its deflecting slope outlet.

In order that the jet regulator according to the invention can be subjected to high loads even without loss of function of its constituent parts, it is advantageous if the pot-like jet splitter has, on the inside of the pot on the pot bottom, a central support peg which, by means of its peg end oriented counter to the flow direction, supports an inflow-side component, and in particular a flow rate regulator.

To form the circularly circumferential outlet jet pattern by means of spray jets which flow out visibly separately from one another, it is advantageous if spray nozzles are connected downstream of the jet ducts in the direction of flow, and if the spray nozzles preferably open out in the outlet-side subregion of the jet regulator housing.

In order for the water which is made turbulent to a greater or lesser degree in the interior of the jet regulator to be shaped to form a homogeneously outflowing jet, it is advantageous if at least one annular insert, which has a lattice or grid structure which serves as a flow straightener, is provided between the jet ducts and the spray nozzles. To further additionally promote the function of said lattice or grid structure as a flow straightener, it is advantageous if the wall sections bounding the lattice or grid openings have a greater longitudinal extent in the throughflow direction in relation to the opening width of said lattice or grid openings.

Here, a particularly advantageous embodiment according to the invention provides that the lattice structure of the annular insert is formed by preferably radial webs which bound throughflow holes, as lattice openings, between one another.

In order that the individual jets that form the annularly encircling outlet jet pattern form a conically widening outlet jet pattern, it is advantageous if at least one internal subregion of the circumferential walls that enclose the spray nozzles is directed obliquely outward.

Here, a particularly simple and easily producible embodiment according to the invention provides that the internal sleeve is formed integrally in the second housing part.

The water guided through the internal sleeve can be easily shaped to form a homogeneous and non-sputtering overall jet if the outlet end side, forming the central outlet opening, of the internal sleeve is configured as a lattice or grid structure which is formed by webs that intersect at intersecting points and enclose discharge openings between one another.

A further solution to the above-stated problem, which may likewise be realized instead of the exemplary embodiments described above or in addition to the features described above, provides that the individual jets formed in the splitter openings are guided against an external duct wall of the jet ducts in at least a first rotary position of the housing parts, and that, to this end, at least one of the duct walls of the splitter openings and preferably an internal duct wall of the splitter openings is oriented obliquely outward with respect to the jet regulator longitudinal axis.

In the case of this invention proposal, the water that is divided up in the jet splitter and guided through the splitter openings is directed from there in the form of individual jets against the external duct wall of the jet ducts, so as to flow from there, at least initially still as individual jets arranged annularly with respect to one another, to the jet regulator outlet.

Here, an ordered and stable outlet jet pattern is further additionally promoted if the jet ducts are arranged in an annular gap between the outer circumference of the internal sleeve and the housing inner circumference of the jet regulator housing.

In order that the individual jets emerging from the jet ducts can, still in the housing interior, form an outlet jet pattern which forms an annular wall, or in order that the individual jets emerge from the jet regulator according to the invention as individual spray jets arranged annularly with respect to one another, it is advantageous if the jet ducts open out in an outlet-side subregion of the jet regulator housing, and if this outlet-side subregion has a clear housing cross section that widens in the outlet direction. In this embodiment, the jet ducts open out, still in the housing interior of the jet regulator housing, in an outlet-side subregion, where they can for example combine to form an annular wall formed from a thin band of water. Since the outlet-side subregion has a clear housing cross section that widens in the outlet direction, said annular wall widens slightly further after emerging from the jet regulator housing, whereby said annular wall is maintained even over a relatively great distance of the emerging water jet without the water collapsing to form a disordered jet pattern.

The stability of the individual spray jets, or of the annular wall that is formed in this case from the individual jets, is maintained over a relatively great distance even after emerging from the jet regulator housing if a profile is provided on the inner circumferential side in the outlet-side subregion of the jet regulator housing, said profile being formed by indentations and protuberances oriented in the direction of flow. Said indentations and protuberances on the housing inner circumference of the jet regulator housing have the effect that the annular wall formed by the water is maintained as a constant water film over a relatively great distance. In order that the outlet jet pattern shaped on the housing inner circumference of the jet regulator housing can emerge in a particularly ordered fashion from the jet regulator according to the invention, it is advantageous if the jet regulator housing has a separation edge on the inner circumference of its outlet-side subregion.

Homogenization of the jet pattern over a large pressure range is promoted if the jet regulator is a constituent part of a sanitary insert unit, and if a flow rate regulator or a throughflow throttle is connected upstream of the jet regulator.

Here, a particularly compact and space-saving design is promoted if the flow rate regulator or the throughflow throttle is insertable into the first housing part as far as a support.

The flow rate regulator or the throughflow throttle can be accommodated in secured fashion in the housing interior of the jet regulator housing, and in particular of the inflow-side first housing part, if an attachment screen or filter screen is connected upstream of the flow rate regulator or the throughflow throttle, said attachment screen or filter screen being fixable to the first housing part preferably in a releasable manner.

Said attachment or filter screen has the task of filtering out any limescale or similar dirt particles contained in the inflowing water, which particles could otherwise impair the function of the insert unit and of its jet regulator.

BRIEF DESCRIPTION OF THE DRAWINGS

Refinements according to the invention will emerge from the claims in conjunction with the drawing and the description. The invention will be described in more detail below on the basis of a preferred exemplary embodiment.

In the drawings.

DETAILED DESCRIPTION OF THE PREFERRED EMBODIMENTS

Figure 22:
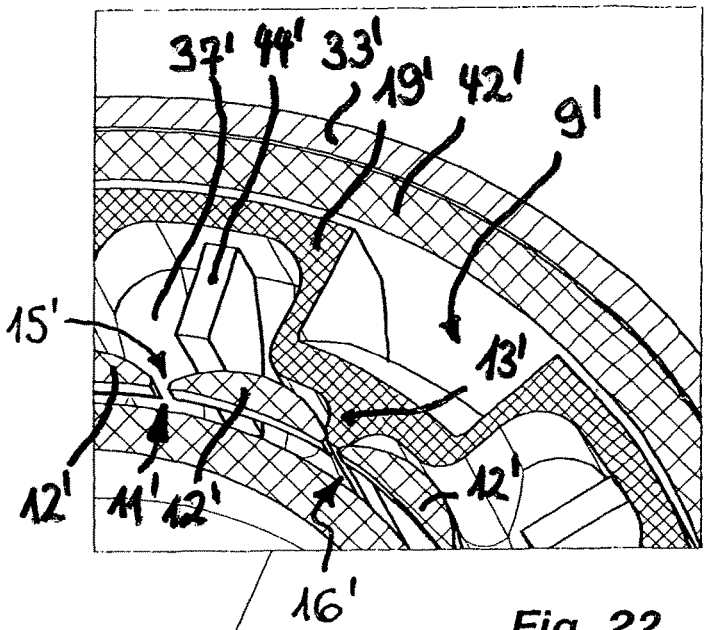
FIG. 22 shows the insert unit from FIGS. 16 to 21 in a cross-sectioned detail view in the region of one of its jet ducts, as indicated in FIG. 21.
Figure 21:
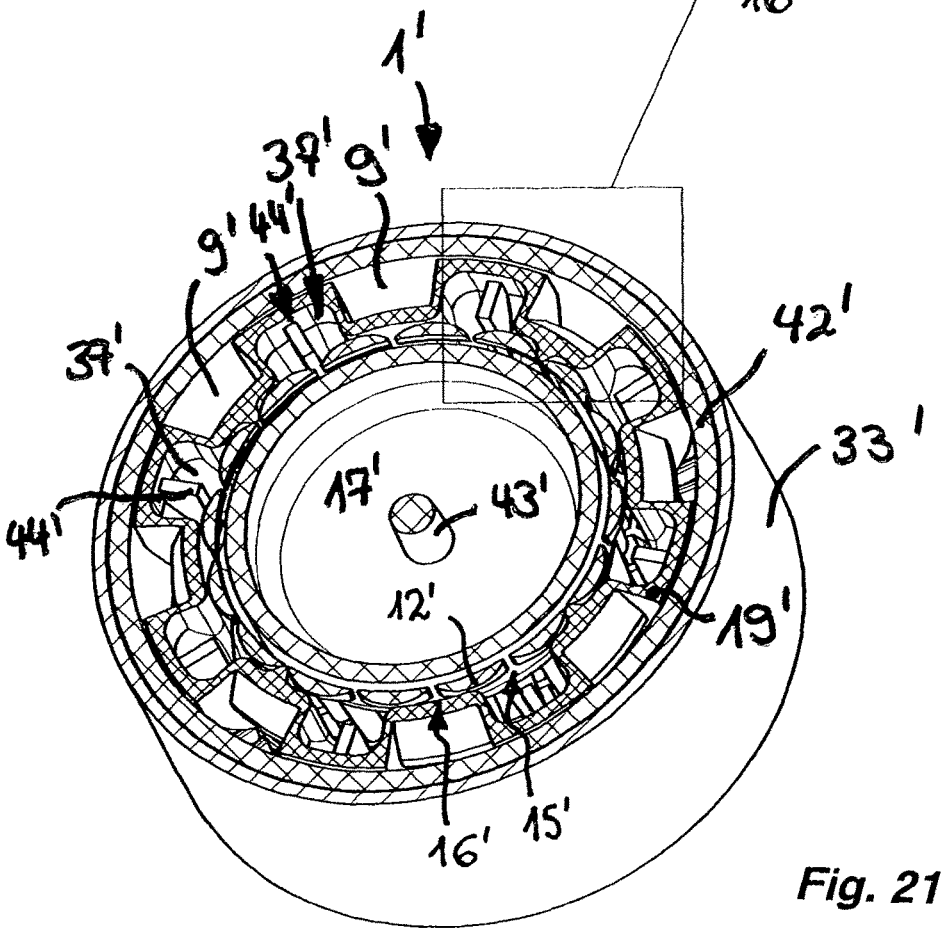
FIG. 21 shows the insert unit from FIGS. 16 to 20 in a cross section.

FIGS. 1 to 29 illustrate two embodiments 1, 1' of a sanitary insert unit. As shown by way of example in FIG. 22, the insert units 1, 1' are mountable with the aid of an outlet mouthpiece 28 on the water outlet of a sanitary outlet fitting (not illustrated in any more detail here). The insert units 1, 1' have an outflow-side jet regulator 2, 2', which is switchable optionally between two outlet jet patterns (cf. FIGS. 1 and 2 and FIGS. 24 and 25). The insert units 1, 1' have an inflow-side attachment or filter screen 3, 3' which has the task of filtering out any limescale or dirt particles contained in the inflowing water, which particles could otherwise become stuck in the insert units 1, 1' and impair the functions thereof. To be able to limit the water flow rate passing through the insert units 1, 1' per unit time to a defined maximum value, a flow rate regulator 4, 4' is in this case arranged between the attachment or filter screen 3, 3' and the jet regulator 2, 2'.

Figure 2:
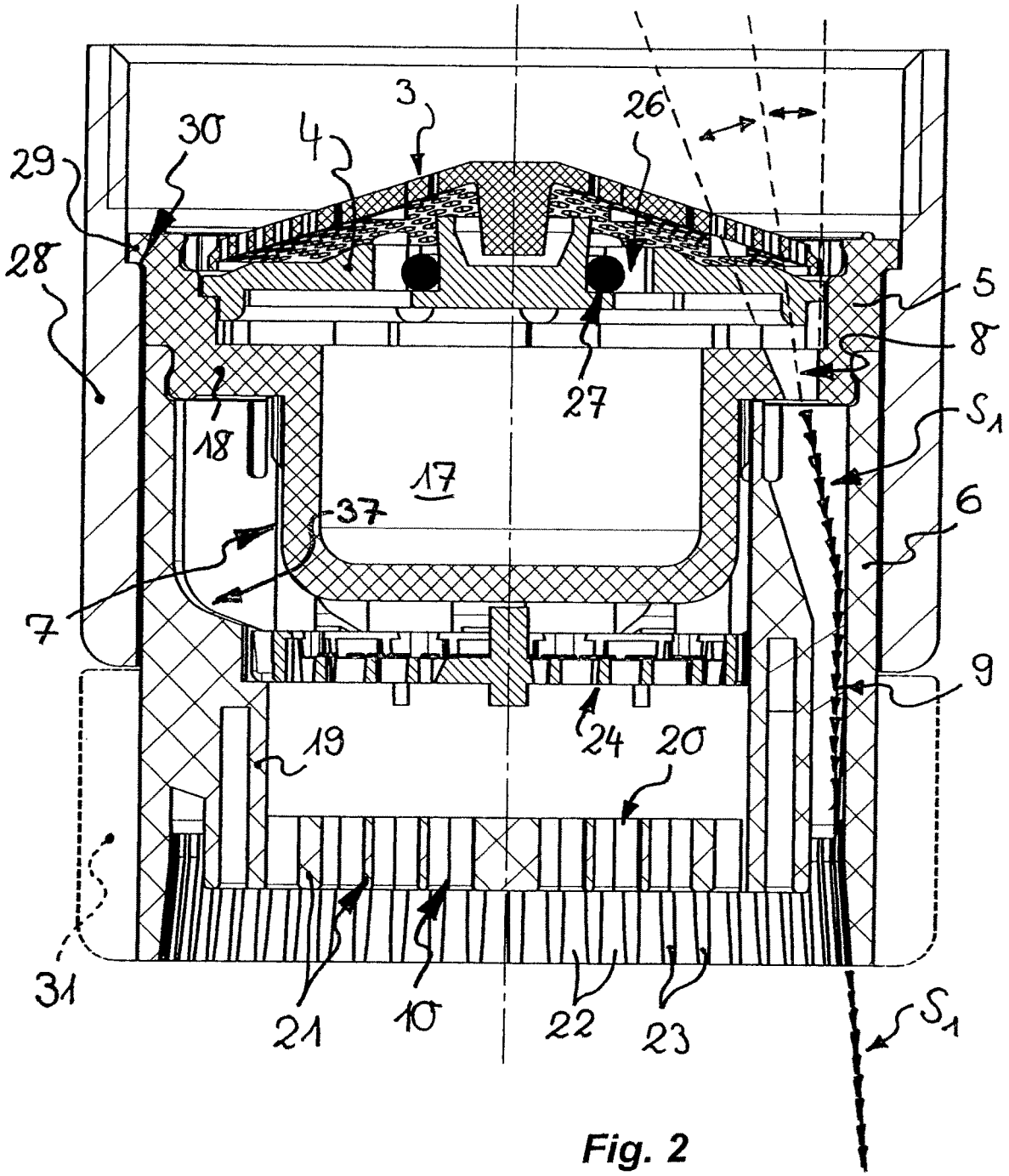
FIG. 2 shows the insert unit from FIG. 1, shown in this case on a much larger scale, in the case of a different rotary position of the housing parts of the jet regulator housing in relation to FIG. 1.

To be able to switch between two outlet jet patterns, the jet regulator 2, 2' of the insert units 1, 1' has at least two housing parts 5, 6; 5', 6' which are rotatable relative to one another. Whereas an inflow-side first housing part 5, 5' is mountable in a rotationally fixed manner on the water outlet of a sanitary outlet fitting and, to this end, has an outer circumferential annular flange or annular shoulder 29, 29' which can be clamped between an inner circumferential annular shoulder 30 in the outlet mouthpiece 28 and the outflow-side end edge of the water outlet of the sanitary outlet fitting, an outflow-side second housing part 6, 6' is, at least at its outflow-side housing outer circumference, configured as a handle or connected to a handle. In FIG. 2, it is indicated by way of example using dashed lines that, in the outflow-side subregion of the second housing part 6, a handling ring 31 can engage on the housing outer circumference thereof, which handling ring serves as a handle for the manual actuation of the jet regulator 2, 2'. By means of the solid lines in FIG. 2, which show the jet regulator 2 and the outflow-side housing part 6 also without a handling ring 31 of said type, it is indicated that the second housing part 6, 6' may also be directly configured, on its outer circumference, as a handle, in order that the second housing part 6, 6' can be gripped there and rotated relative to the first housing part 5, 5'. The first housing part 5, 5' has a jet splitter 7, 7' which has a number of splitter openings 8, 8' in which the inflowing water is divided up into a corresponding number of individual jets.

Figure 1:
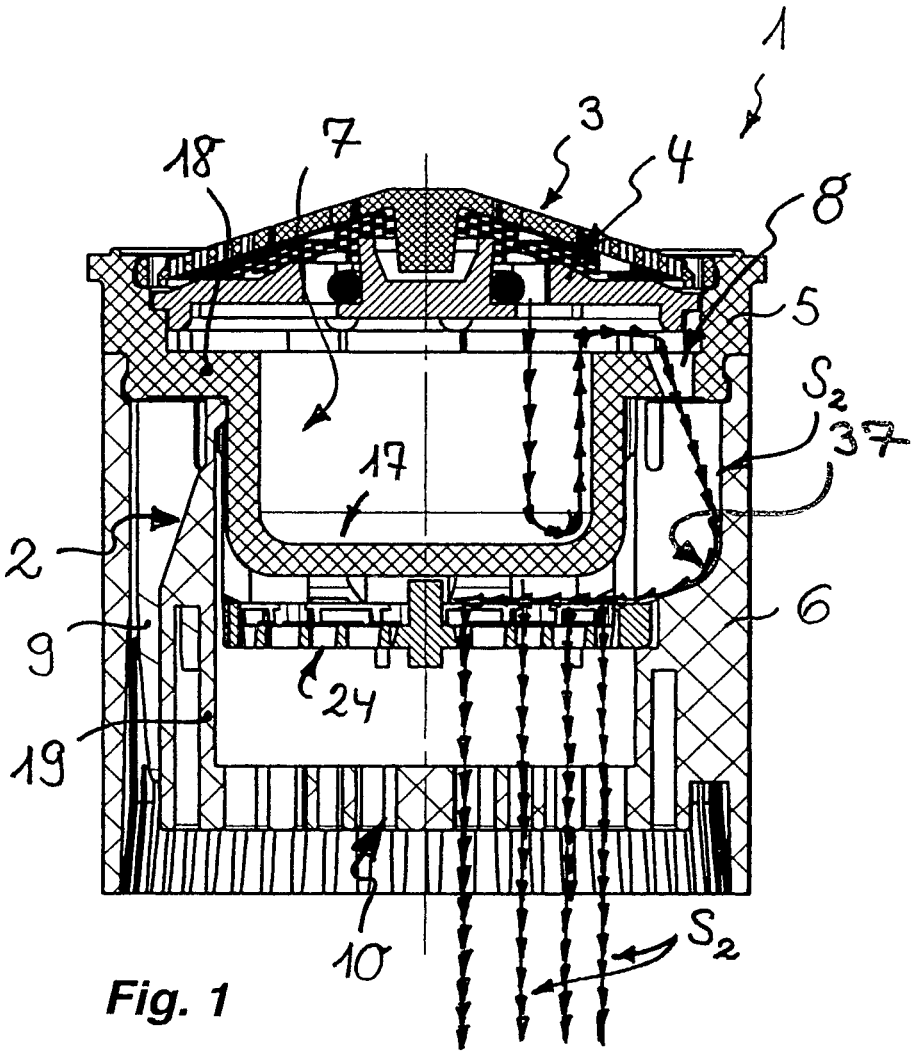
FIG. 1 shows a sanitary insert unit illustrated in longitudinal section, which insert unit is mountable with the aid of an outlet mouthpiece on the water outlet of a sanitary water outlet fitting, and which insert unit comprises an outflow-side jet regulator, an inflow-side attachment or filter screen and a flow rate regulator arranged in between, wherein the jet regulator housing has two housing parts which are rotatable relative to one another for the purposes of choosing between two outlet jet patterns of the jet regulator.
Figure 4:
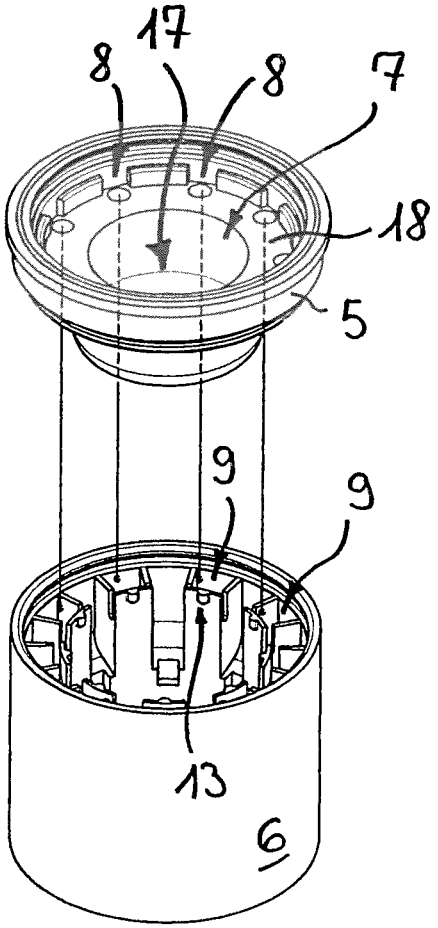
FIG. 4 shows the insert unit from FIGS. 1 to 3 in an exploded perspective illustration of the housing parts in a relative position corresponding to the rotary position as per FIG. 2.
Figure 3:
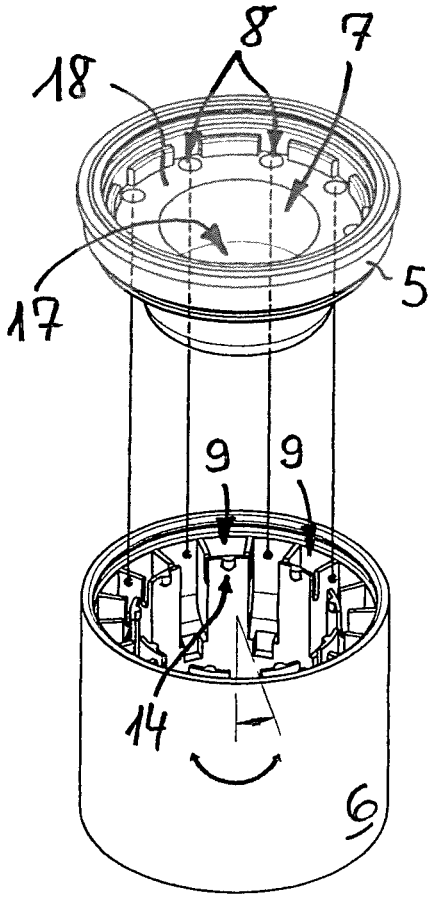
FIG. 3 shows the insert unit from FIGS. 1 and 2 in an exploded perspective illustration of the housing parts in the case of a relative position corresponding to the rotary position as per FIG. 1.
Figure 5:
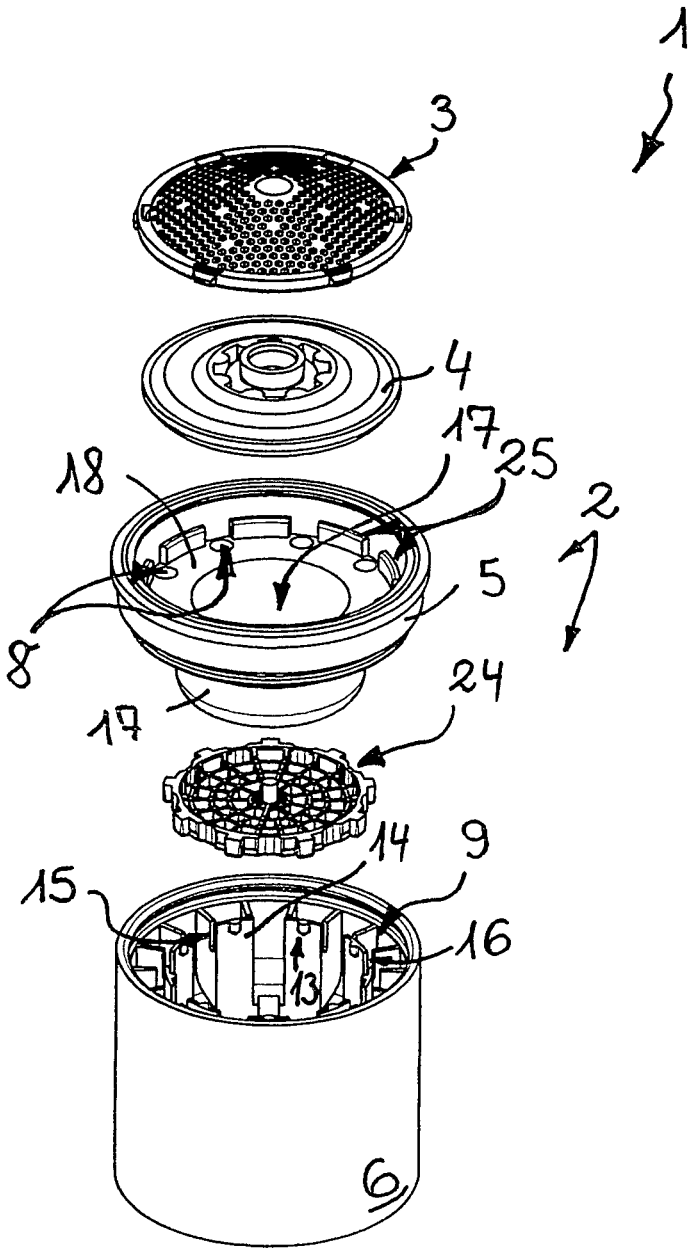
FIG. 5 shows the insert unit from FIGS. 1 to 4 in an exploded illustration of the individual parts, in a view directed approximately in a throughflow direction.
Figure 6:
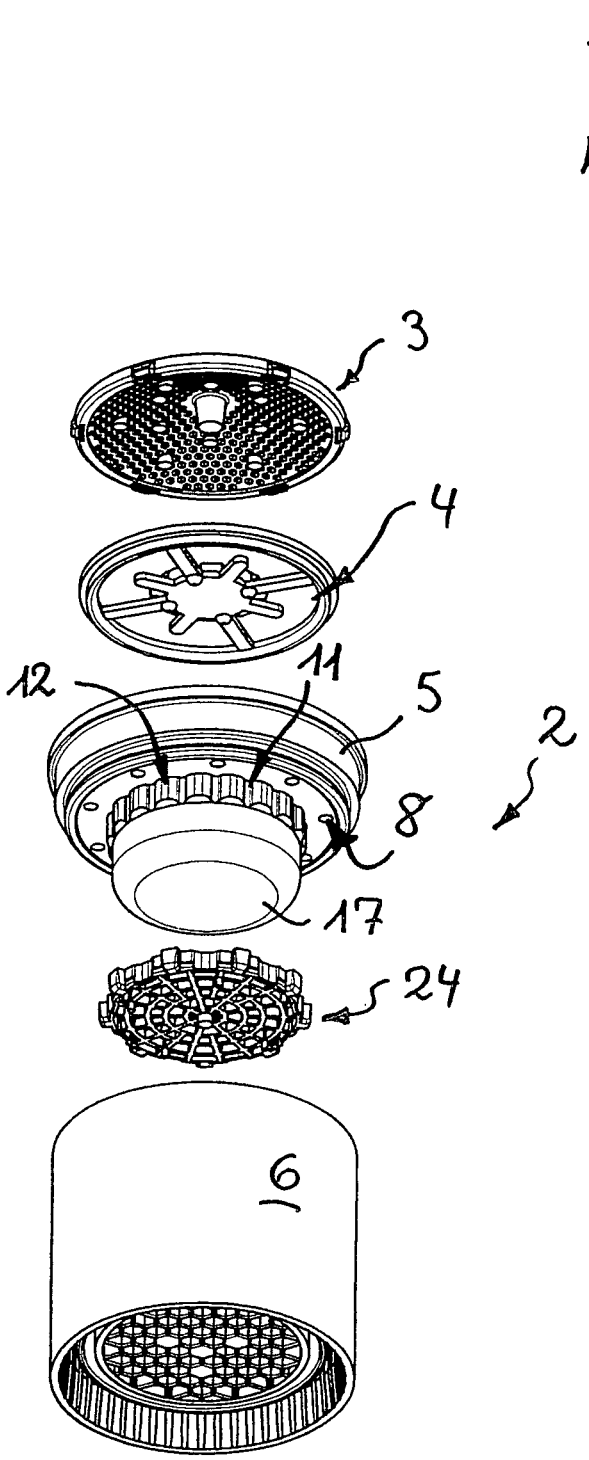
FIG. 6 shows the insert unit from FIGS. 1 to 5 in an exploded illustration of the individual parts, in a view directed counter to the throughflow direction.
Figure 7:
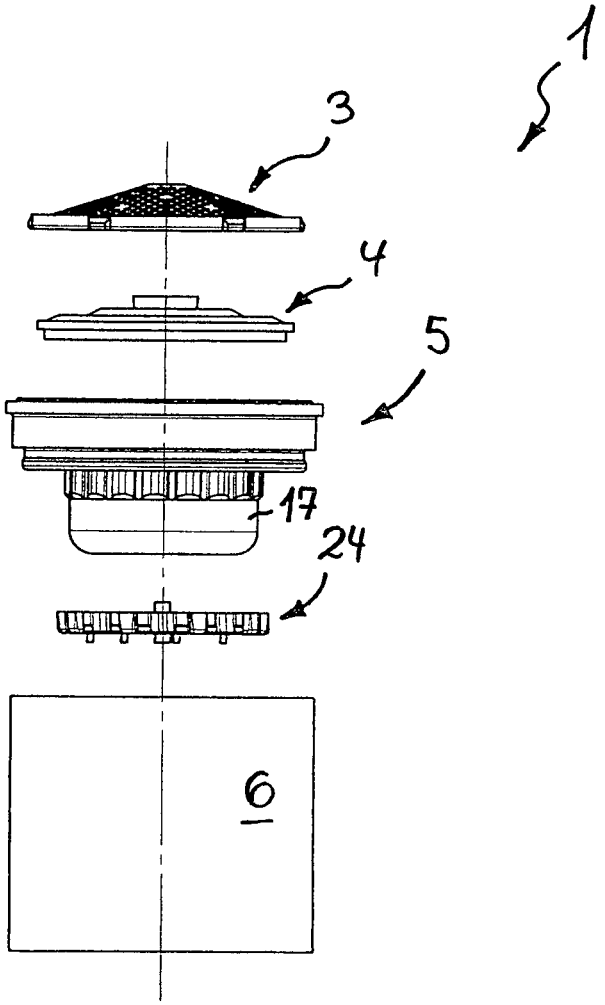
FIG. 7 shows, in a side view, the individual parts of the insert unit from FIGS. 1 to 6.
Figure 24:
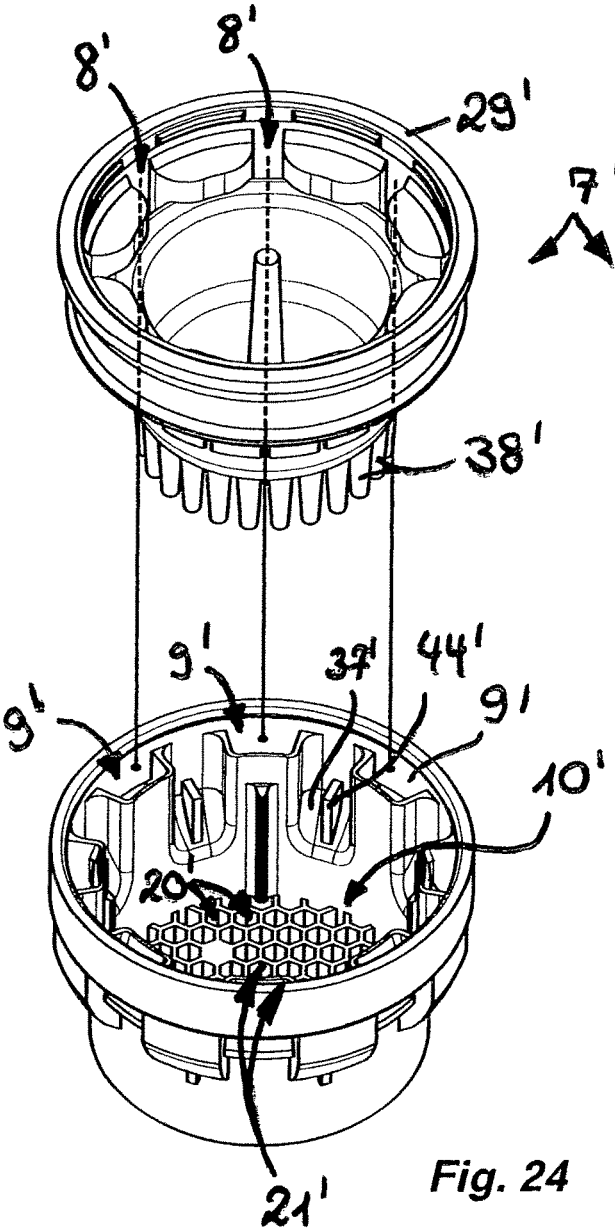
FIG. 24 shows the housing parts of the insert unit shown in FIGS. 16 to 23, in a first rotary position.
Figure 25:
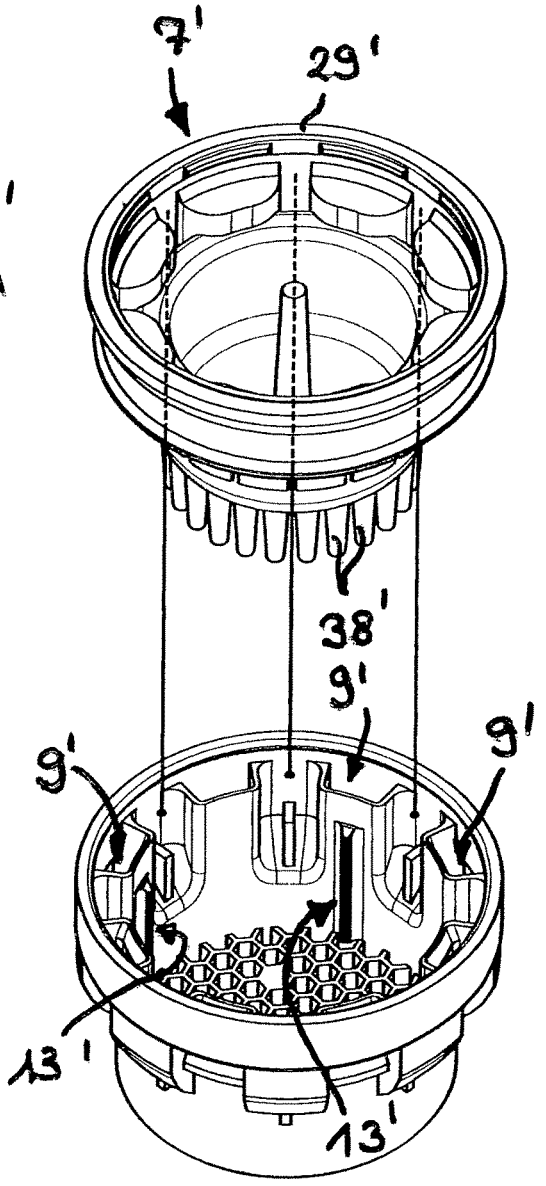
FIG. 25 shows the housing parts from FIG. 21 in a second rotary position.
Figure 26:
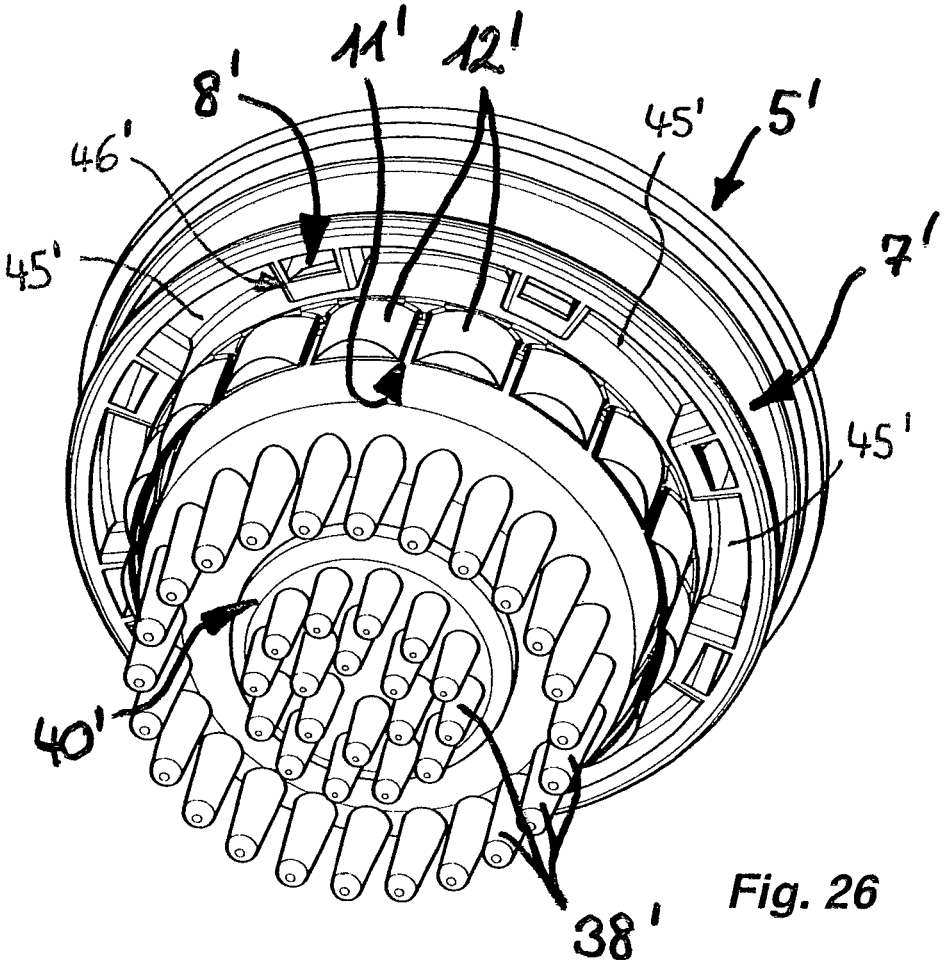
FIG. 26 shows the inflow-side first housing part of the insert unit shown in FIGS. 16 to 25 in a perspective view from below of the outflow side.
Figure 27:
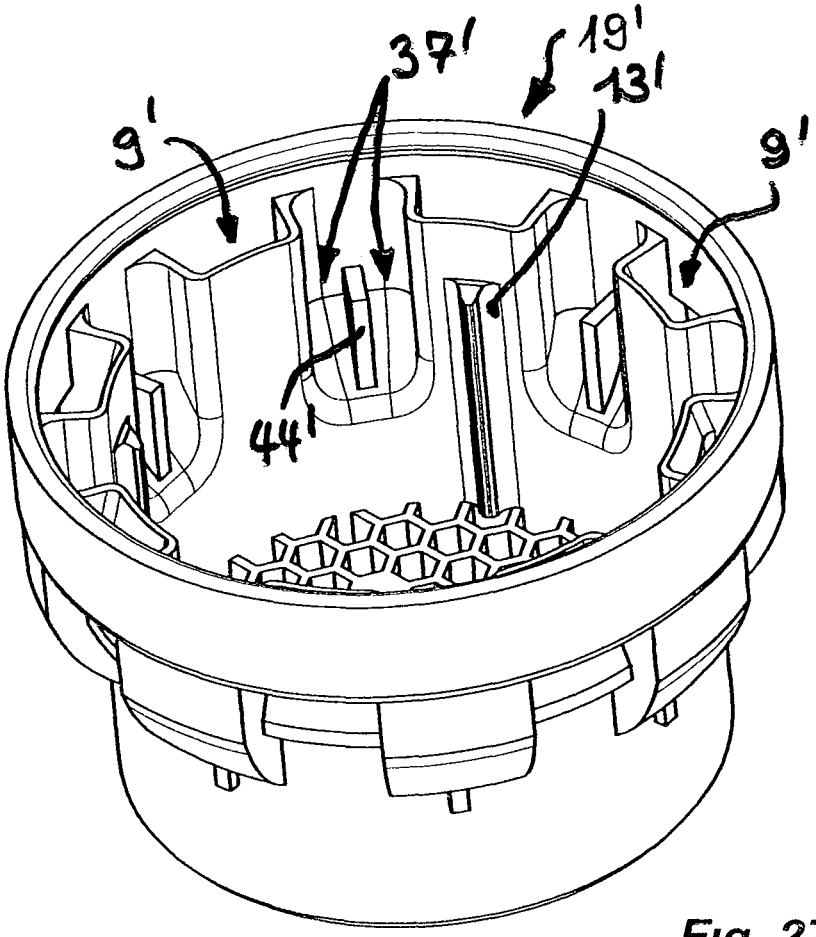
FIG. 27 shows the outflow-side second housing part in a perspective plan view of the inflow side.
Figure 28:
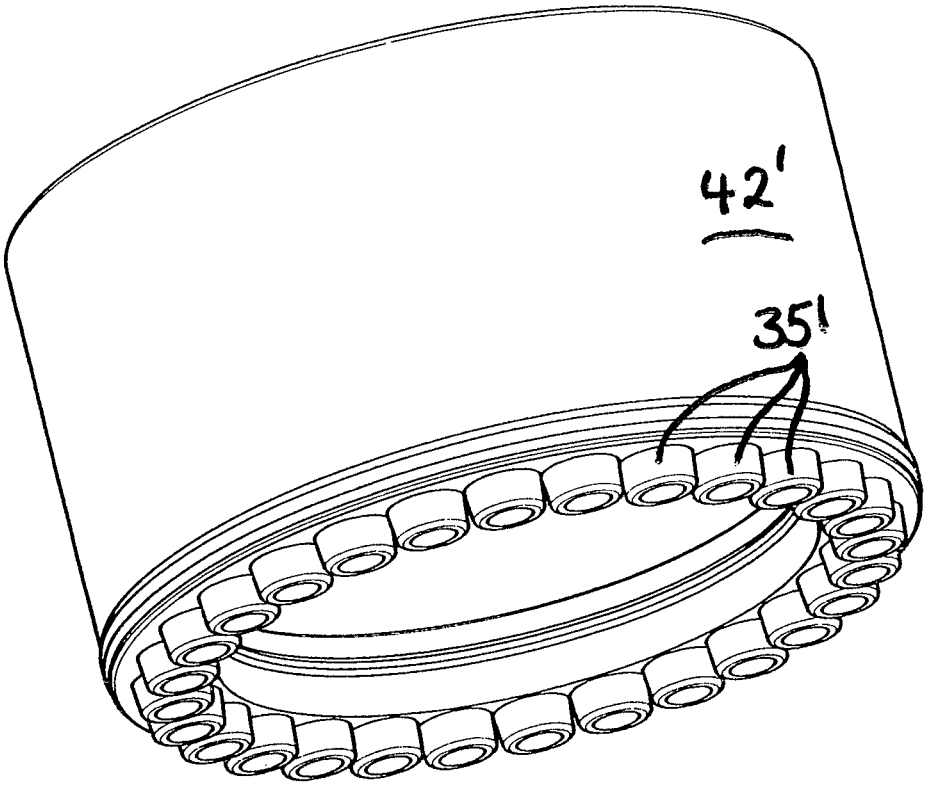
FIG. 28 shows the outflow-side second housing part in a view from below of the outflow side thereof.
Figure 29:
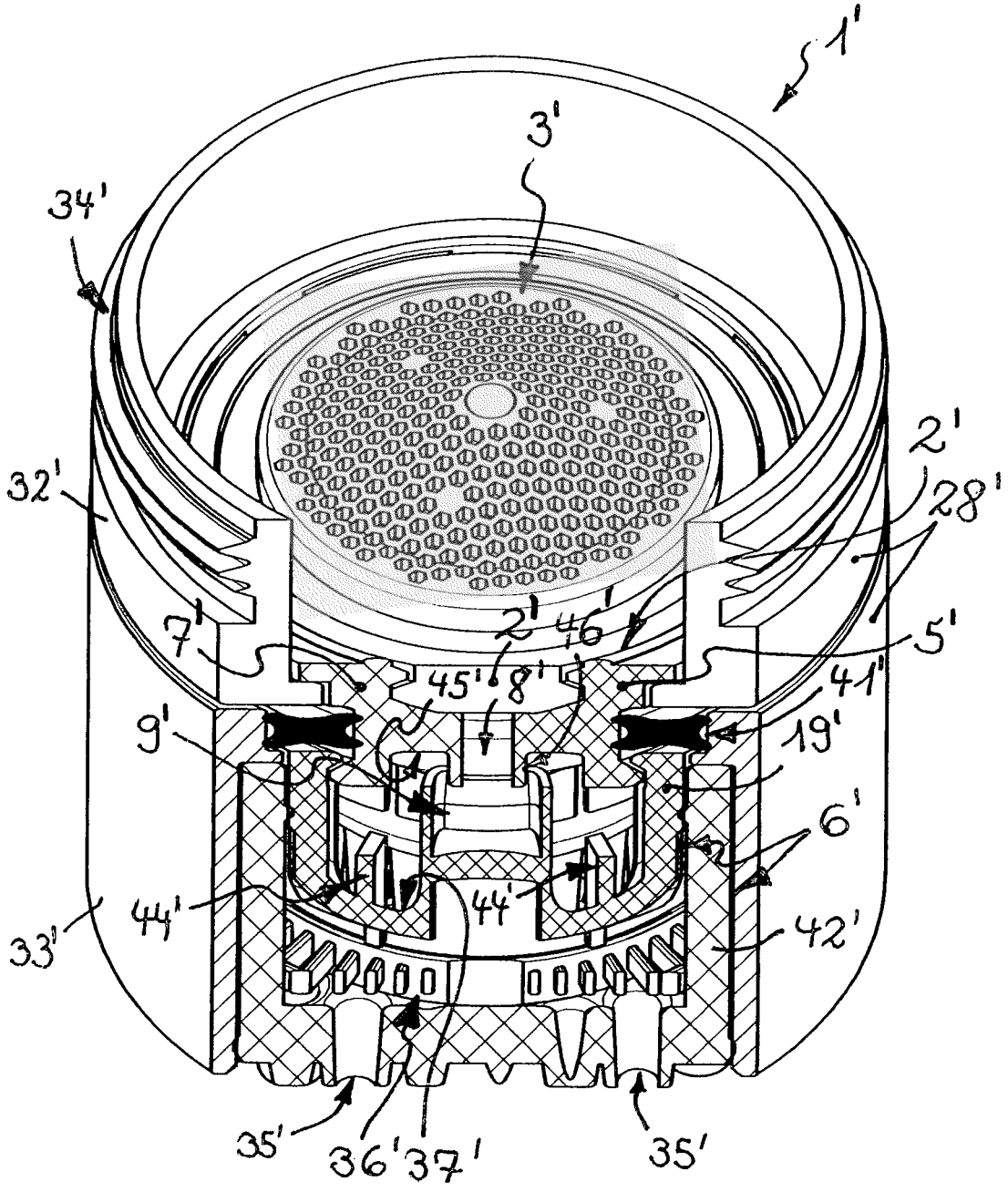
FIG. 29 shows the insert unit shown in FIGS. 16 to 28 in a perspective section in a longitudinal direction in the region of one of the jet ducts.

Spaced-apart jet ducts 9, 9' are provided on the housing inner circumference of the second housing part 6, wherein the individual jets coming from the splitter openings 8, 8' are guided through the jet ducts 9, 9' and formed into an annularly circumferential outlet jet pattern for example in the rotary position of the housing parts 5, 6; 5', 6' as shown in FIGS. 2 and 4 and FIG. 24, whereas the individual jets coming from the splitter openings 8, 8' are deflected in the housing interior of the jet regulator 2 to a central outlet opening 10, 10' in the jet regulator housing in the rotary position shown in FIGS. 1 and 3 and FIG. 25.

To be able to choose and differentiate between the outlet jet patterns, a rotary latch is provided between the first and the second housing part 5, 6; 5', 6'. To this end, on a circumferential wall of the first housing part 5, 5', there is provided a latching profile formed from latching indentations 11, 11' and latching cams 12, 12', which latching profile interacts with latching teeth 13, 13' which are in each case integrally formed on the duct wall, facing toward the housing interior of the jet regulator housing, of the jet ducts 9, 9'. The housing parts 5, 6; 5', 6' can thus be oriented relative to one another in an exact manner, such that the flow paths in the housing interior of the jet regulator housing that lead to a defined outlet jet pattern can be exactly adhered to.

Figure 8:
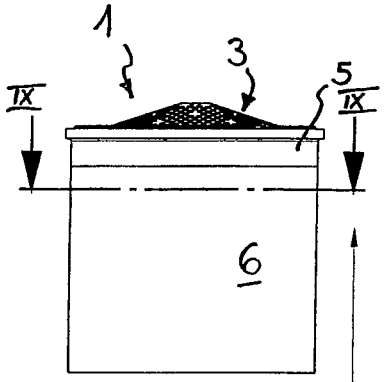
FIG. 8 shows, in a side view, the insert unit from FIGS. 1 to 7.
Figure 10:
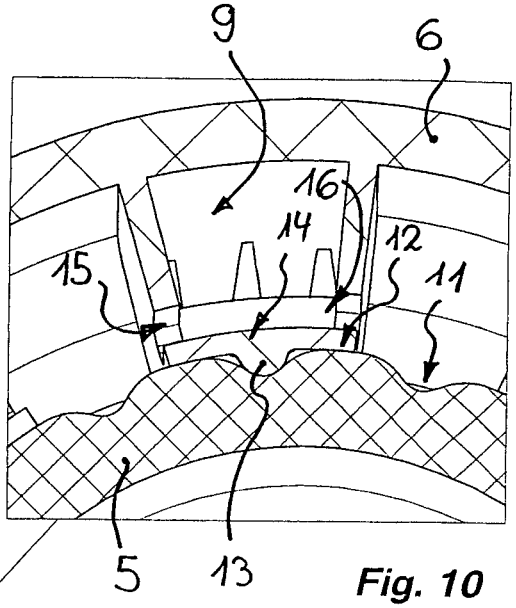
FIG. 10 shows a detailed view, in the detail shown in FIG. 9, in the region of a rotary latch provided between the housing parts.
Figure 9:
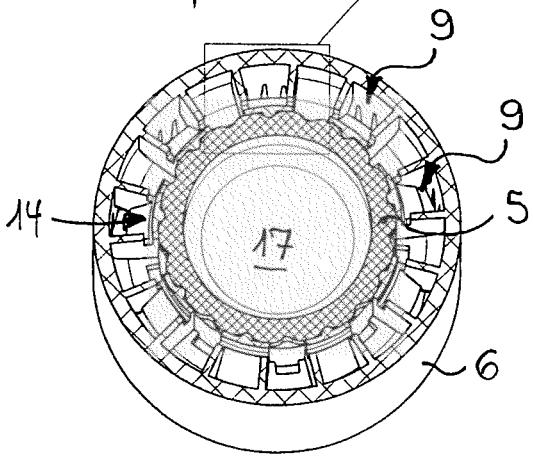
FIG. 9 shows the insert unit from FIGS. 1 to 8 in a perspective cross section through section plane IX-IX as per FIG. 8.
Figure 11:
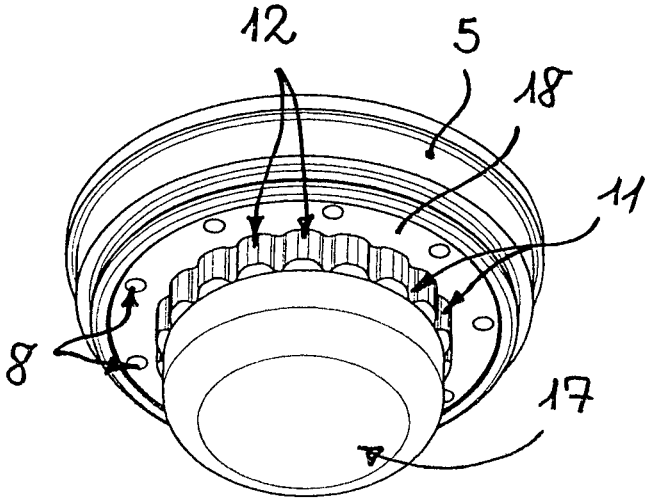
FIG. 11 shows a perspective view from below of the inflow-side first housing part.
Figure 12:
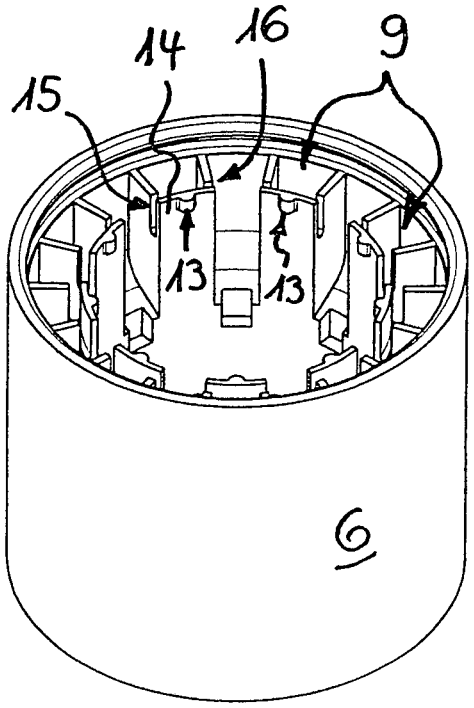
FIG. 12 shows a perspective plan view of the outflow-side second housing part.
Figure 13:
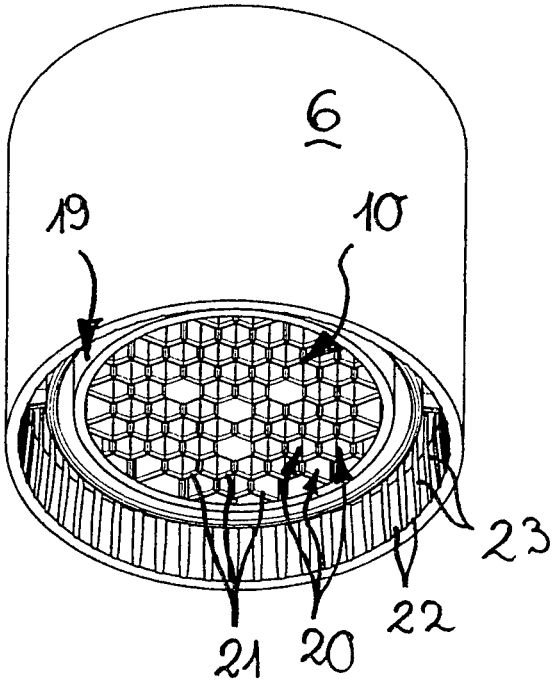
FIG. 13 shows a perspective view from below of the outlet end side of the second housing part.
Figure 14:
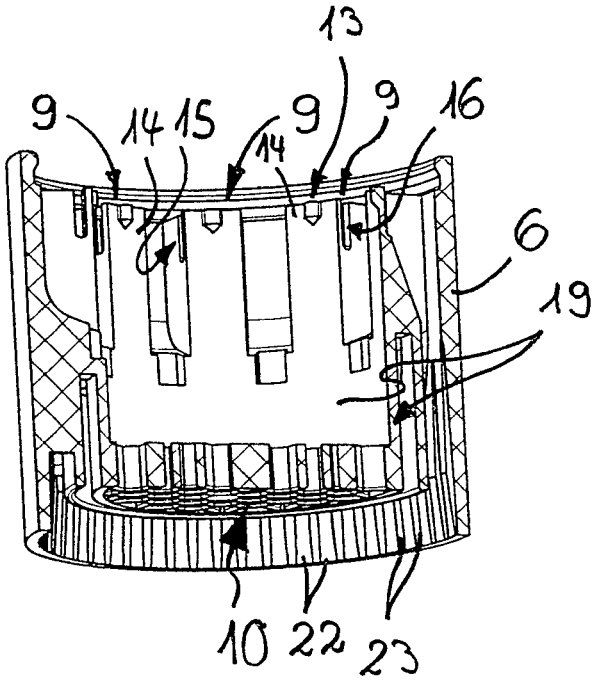
FIG. 14 shows a perspective longitudinal section through the outflow-side second housing part, in a view counter to the throughflow direction.

From a comparison of FIGS. 8 to 10, it is clear that, in the case of the insert unit 1 illustrated therein, the subregion, bearing the latching teeth 13, of that duct wall of the jet ducts 9 which faces toward the housing interior is formed in each case as a flexible tongue 14. Said flexible tongues are separated on both sides from the adjacent duct side walls of the jet ducts 9 by wall incisions 15, 16.

The latching indentations 11, 11' and the latching projections or latching cams 12, 12' of the latching profile are connected to one another by means of straight latching flanks, wherein a profile rounding is provided between in each case one latching flank and one latching indentation 11, 11' or one adjacent latching cam 12, 12'. To realize a fully functioning latch which is however of structurally very simple design, the latching profile is of asymmetrical design with regard to its latching indentations 11, 11' and its latching cams 12, 12'. Whereas the latching cams 12, 12' are formed in the manner of planar mountain peaks, followed by a radius and subsequently another straight flank, this is followed in turn by a radius, a straight flank and subsequently a radius leading to the latching indentation, wherein the latching indentation 11, 11' is in this case in the form of a continuous radius. To realize a clean latching position of the rotary latch, it is provided here that the radii of the profile roundings and of the latching cams 13, 13' approximately correspond.

From a comparison of FIGS. 1 to 11, it is clear that the jet splitter 7, 7' has two jet splitter subregions 17, 17'; 18, 18', of which a central first jet splitter subregion 17, 17' is configured in a pot-like manner. Said central first jet splitter subregion 17, 17' is connected to a second jet splitter subregion 18, 18' which is configured as a circumferential annular flange or annular shoulder and which has the splitter openings 8, 8'. Here, the splitter openings 8, 8' are preferably arranged in a manner distributed regularly over the second jet splitter subregion 18, 18'.

The water flowing through the supply line and the fitting body flows through the attachment or filter screen 3, 3' and through the flow rate regulator 4, 4' firstly into the centrally arranged pot-like jet splitter subregion 17, 17', and is slowed there before the water is subsequently deflected in the direction of the splitter openings 8, 8' provided in the second jet splitter subregion 18, 18'. Here, the pot-like jet splitter subregion 17, 17' serves as a calming zone for the inflowing water; said pot-like jet splitter subregion 17, 17' is configured in a hole-free manner.

The second housing part 6, 6' is configured in a sleeve-like manner at least in its inflow-side subregion. The first and the second housing part 5, 6; 5', 6' are releasably latched together, wherein the first housing part 5 connected integrally to the jet splitter 7, 7' is inserted into the second housing part 6, 6' such that the pot-like first jet splitter subregion 17, 17' of the first housing part 5 protrudes into the sleeve interior of the second housing part 6, 6'.

In the figures, it can be seen particularly clearly that an internal sleeve 19, 19' is provided in the second housing part 6, 6', the outlet end side of which internal sleeve forms the central outlet opening 10, 10' of the jet regulator housing. Said internal sleeve 19 is, in the insert unit 1, formed integrally in the second housing part 6. The outlet end side, which forms the central outlet opening 10, 10', of the internal sleeve 19, 19' is in this case configured as a lattice or grid structure which is formed by webs 21, 21' which intersect at intersecting points and which bound outlet openings 20, 20' between one another. The webs 21, 21' of said lattice structure are in this case arranged such that the outlet openings 20, 20' practically form a honeycomb-like lattice structure.

In the rotary position of the housing parts 5, 6 shown in FIGS. 2 and 4, the individual jets formed in the splitter openings 8 are guided against the external duct wall of the jet ducts 9. Said flow path is indicated in FIG. 2 by the arrow line S1. To guide the individual jets formed in the splitter openings 8 against the external duct wall, at least the internal inner circumferential wall of the splitter openings 8 is oriented obliquely outward. Here, each individual jet emerges from the associated jet duct 9 on the angle bisector of the oppositely situated duct walls, wherein each individual jet, after striking the housing inner circumferential wall, is flattened and thus forms a closed water curtain which practically forms an encircling circumferential wall.

Figure 15:
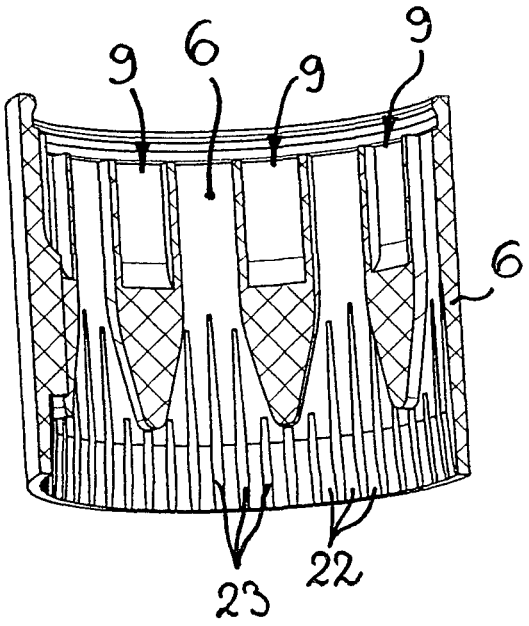
FIG. 15 shows a longitudinal section, rotated slightly in a circumferential direction, through the outflow-side second housing part, in which the profiled housing inner circumference on the second housing part is now visible.

It can be seen in FIG. 15 that, on the inner circumference in the outlet-side subregion of the jet regulator housing, there is provided a profile which is formed by indentations and protuberances 22, 23. Here, the indentations 22 formed between two adjacent protuberances 23 taper in the outflow direction such that the spray jet generated in the rotary position as per FIG. 2 can continue to spread as far as the outlet from the jet regulator housing. The indentations and protuberances 22, 23 form guide ribs and guide grooves on the housing inner circumference, which guide ribs and guide grooves further promote the spreading of each individual jet, such that an outlet region which widens conically outward is realized which imparts to the spray jet a divergent direction in relation to the jet regulator longitudinal axis. The spreading of the spray jet form from the individual jets is further promoted in that the outlet-side subregion of the second housing part 6 has a clear housing cross section that widens in the outlet direction, and in that a sharp separation edge is provided on the inner circumference of said outlet-side subregion.

In the rotary position shown in FIGS. 1 and 3, the water coming from the flow rate regulator 4 is guided outward in a radial direction to the splitter openings 8, in order to subsequently be guided as individual jets through the free spaces or longitudinal gaps that remain between the jet ducts 9, which free spaces or longitudinal gaps each transition into a radially inwardly formed rounding, which serves as a deflecting slope 37 which deflects said individual jets in the direction of the inner sleeve 19. An insert part 24 is inserted into the internal sleeve 19 at the inflow side, which insert part has a lattice or grid structure formed from webs which intersect at intersecting points. The flow path corresponding to the rotary position of the housing parts 5, 6 as per FIGS. 1 and 3 is indicated in FIG. 1 by the arrow lines S2. Since the splitter openings 8 of the jet splitter 7 constitute cross-sectional constrictions, the individual jets formed in the splitter openings 8 undergo a speed increase which, in accordance with the Bernoulli equation, leads to a negative pressure on the outflow side of the jet splitter 7. The negative pressure formed on the outflow side of the jet splitter 7 has the effect that ambient air is drawn into the housing interior of the jet regulator housing via the jet ducts 9, which ambient air is formed there with the individual jets into a homogeneous, non-sputtering and sparkling, soft overall jet. Here, the mixing chamber formed between the insert part 24 and the outflow-side end side of the pot-like jet splitter subregion 17 is reduced owing to the pot-like design of the jet splitter 7, in such a way that a relatively small mixing chamber is formed, in which no undesired resonance can arise. The thorough mixing of the ambient air that is drawn into the housing interior with the water flowing through the jet regulator 2 is further additionally promoted by the lattice or grid structure of the insert part 24, which is arranged on the outflow side of the mixing chamber and which is inserted into the housing interior of the jet regulator housing.

From a comparison of the rotary positions shown in FIGS. 1 and 3, on the one hand, and in FIGS. 2 and 4, on the other hand, it can be seen that the flow paths S1 and S2 require no sealing between the two jet types of the jet regulator 2—specifically a jet which emerges as a widening annular wall, on the one hand, and an aerated overall jet, on the other hand.

The flow rate regulator 4 is insertable into the first housing part 5 as far as a support 25, 25'. Since the attachment or filter screen 3, 3' is releasably connected, preferably releasably latchable, to the first housing part 5, 5', the flow rate regulator 4, 4' positioned downstream of the attachment or filter screen 3, 3' in the flow direction is accommodated in space-saving fashion in the interior of the first housing part 5, 5' in the region of the jet splitter 7, 7'. The flow rate regulator 4, 4' has in this case at least one annular gap 26, 26' into which in each case one annular throttle body 27, 27' composed of elastic material is placed. The at least one annular gap 26, 26' has a regulating profile on its inner and/or outer circumferential wall, between which regulating profile and the elastic throttle body 27, 27' there remains a regulating gap which narrows under the increasing pressure of the inflowing water, in such a way that the water quantity flowing through per unit time is limited to a set maximum value.

The insert unit 1' shown in FIGS. 16 to 29 is also mountable with the aid of an outlet mouthpiece 28' on the water outlet of a sanitary water outlet fitting (not shown in any more detail here). The outlet mouthpiece 28' is formed in at least two parts and has an inflow-side and an outflow-side portion 32', 33', which portions 32', 33' are rotatably connectable to one another. An internal thread or—as is the case here—external thread 34' is provided on the inflow-side portion 32' of the outlet mouthpiece 28', which thread can be mounted into a corresponding external or internal thread on the water outlet. The portions 32', 33' of the outlet mouthpiece 28' which are rotatably connected to one another are each of sleeve-shaped form, wherein the sleeve interiors thereof transition into one another. The jet regulator 2' is inserted into the sleeve interiors of the outlet mouthpiece 28' and of its portions 32', 33'.

The jet regulator 2' is likewise switchable between two outlet jet patterns. To be able to switch between two outlet jet patterns, the jet regulator 2' also has two housing parts 5', 6' which are rotatable relative to one another. Whereas the inflow-side first housing part 5' is held fixedly on the water outlet with the aid of the portion 32', the outflow-side second housing part 6' is rotationally conjointly connected to that portion 33' of the outlet mouthpiece 28' which serves as a handle, in such a way that the second housing part 6' can be rotated relative to the first housing part 5'.

On the housing inner circumference of the second housing part 6' there are provided jet ducts 9' which are preferably regularly spaced apart from one another in the circumferential direction and which receive the individual jets coming from the splitter openings 8' of the jet splitter 7'. Here, the second housing part 6' is formed from two separate parts, of which the internal sleeve 19' is inserted into an external sleeve 42'. In one rotary position, the first rotary position, of the housing parts 5', 6', the individual jets coming from the splitter openings 8' are guided onward between the internal sleeve 19' and the external sleeve 42' of the second housing part 6', before reaching the spray nozzles 35' arranged at the outflow side, which spray nozzles open out in the outlet-side subregion of the jet regulator housing. In the annular chamber situated between the jet ducts 9' and the spray nozzles 35', the jet regulator 2' has at least one annular insert 36' which has a lattice or grid structure and which is intended to serve as a flow straightener which homogenizes the water flowing through. Said lattice structure is, in the case of the annular insert 36' used here, formed by radial webs which bound throughflow holes between one another. Since at least the inner subregion of the circumferential walls that bound the spray nozzles 35' is directed obliquely outward, the individual jets which emerge visibly separately from the spray nozzles 35' are deflected obliquely outward, such that an annularly circumferential outlet jet pattern formed from individual jets flowing apart from one another is formed.

In the second rotary position of the housing parts 5', 6' in relation thereto, the individual jets emerging from the splitter openings 8' are guided in each case over a deflecting slope 37' which, in said second rotary position, deflects the individual jets formed in the splitter openings 8' radially inward in the direction of the central outlet opening 10'. Here, in each case one of the deflecting slopes 37' is provided between adjacent jet ducts 9'. In the deflecting slopes 37' there is provided in each case one flipper- or fin-like flow divider 44' which effects a first division of the inflowing water. The fin-like flow divider 44' causes the water that has been deflected radially inward at the deflecting slope 37' to be divided in each case into at least two partial flows, wherein the partial flows thus deflected radially inward each in turn strike the pins 38' protruding from the outflow side of the jet splitter 7', and are divided up once again there such that the water flowing through the jet regulator 1' is mixed particularly thoroughly with the ambient air. The water thus mixed with ambient air can subsequently emerge from the jet regulator 2' as an aerated water jet via the central outlet opening 10'.

As already described with regard to the insert unit 1 shown in FIGS. 1 to 15, it is also the case that the water guided over the deflecting slopes 37' is mixed, in the interior of the jet regulator housing, with ambient air. Since the splitter openings 8' of the jet splitter 7' also constitute cross-sectional constrictions, the individual jets formed in the splitter openings 8' undergo a speed increase which, in accordance with the Bernoulli equation, leads to a negative pressure on the outflow side of the jet splitter 7'. The negative pressure formed on the outflow side of the jet splitter 7' has the effect that ambient air is drawn into the housing interior of the jet regulator housing via the spray nozzles 35', which ambient air is formed there with the individual jets into a homogeneous, non-sputtering and sparkling, soft overall jet, which flows out via the central outlet opening 10'. The thorough mixing of the ambient air that is drawn into the housing interior with the water flowing through the jet regulator 2 is further additionally promoted by the pins 38' which protrude in the flow direction from the outflow side of the pot bottom of the pot-like jet splitter 7'. In the rotary position shown in FIG. 25, the ambient air that is drawn in via the spray nozzles 35' is guided via the air intake ducts, which are oriented approximately in the longitudinal extent of the jet regulator 2', of the inflow-side first housing part 5', wherein, there, pocket-like cutouts 45' are situated on the outflow side of the jet splitter 7'. Viewing FIGS. 21, 22, 26, 27 and 29 together, it is clear that the splitter openings 8' of the jet splitter 7' open into duct-like discharge ducts, which are separated from one another in the circumferential direction by said pocket-like cutouts 45' on the outflow side of the jet splitter 7'. In the rotary position shown in FIG. 25, in which the water mixed with ambient air flows out of the jet regulator 2' through the central outlet opening 10', excessive sputtering of the water impinging on the deflecting slope 37' is avoided, which water could otherwise flow out via the jet ducts 9' which, in this rotary position, serve as air intake ducts. In the rotary position shown in FIG. 25, said pocket-like cutouts 45' realize a spray guard action which prevents leakage flows from emerging from the spray nozzles 35'. By means of said pocket-like cutouts 45', not only is it possible to achieve a material saving during the production of the housing part 5', but said cutouts 45' which conduct the ambient air also offer improved protection against water sputtering.

In the exemplary embodiments 1, 1' shown in FIGS. 1 to 29, spaced-apart pin- or web-like flow obstructions are provided on the outflow side of the deflecting slopes 37, 37'. Here, in the case of the jet regulator 1 shown in FIGS. 16 to 28, pins 38' are integrally formed on the pot bottom on the outflow side of the pot-like jet splitter 7', which pins form pin-like flow obstructions of said type. The water which is deflected inward in said rotary position is guided through said spaced-apart pins 38' and is thereby additionally slowed. The pins 38' taper toward their outflow-side pin ends and have a rounded pin end. Here, on the pot bottom of the pot-like jet splitter 7', there is a protruding central pot bottom subregion 40', wherein said pot bottom of the jet splitter 7' is, to this end, of stepped form at least on its outflow side. Despite said stepped design of the pot bottom, the pin ends of the pins 38' are arranged approximately in a plane. The individual jets coming from the splitter openings 8', which individual jets have, below the pot bottom of the pot-like jet splitter 7', been guided by means of the deflecting slopes 37' through the spaced-apart pins 38' oriented in the jet regulator longitudinal direction, are subsequently guided to the central outlet opening 10', which shapes the outflowing water into a homogeneous, non-sputtering and sparkling, soft outlet jet pattern.

Figure 16:
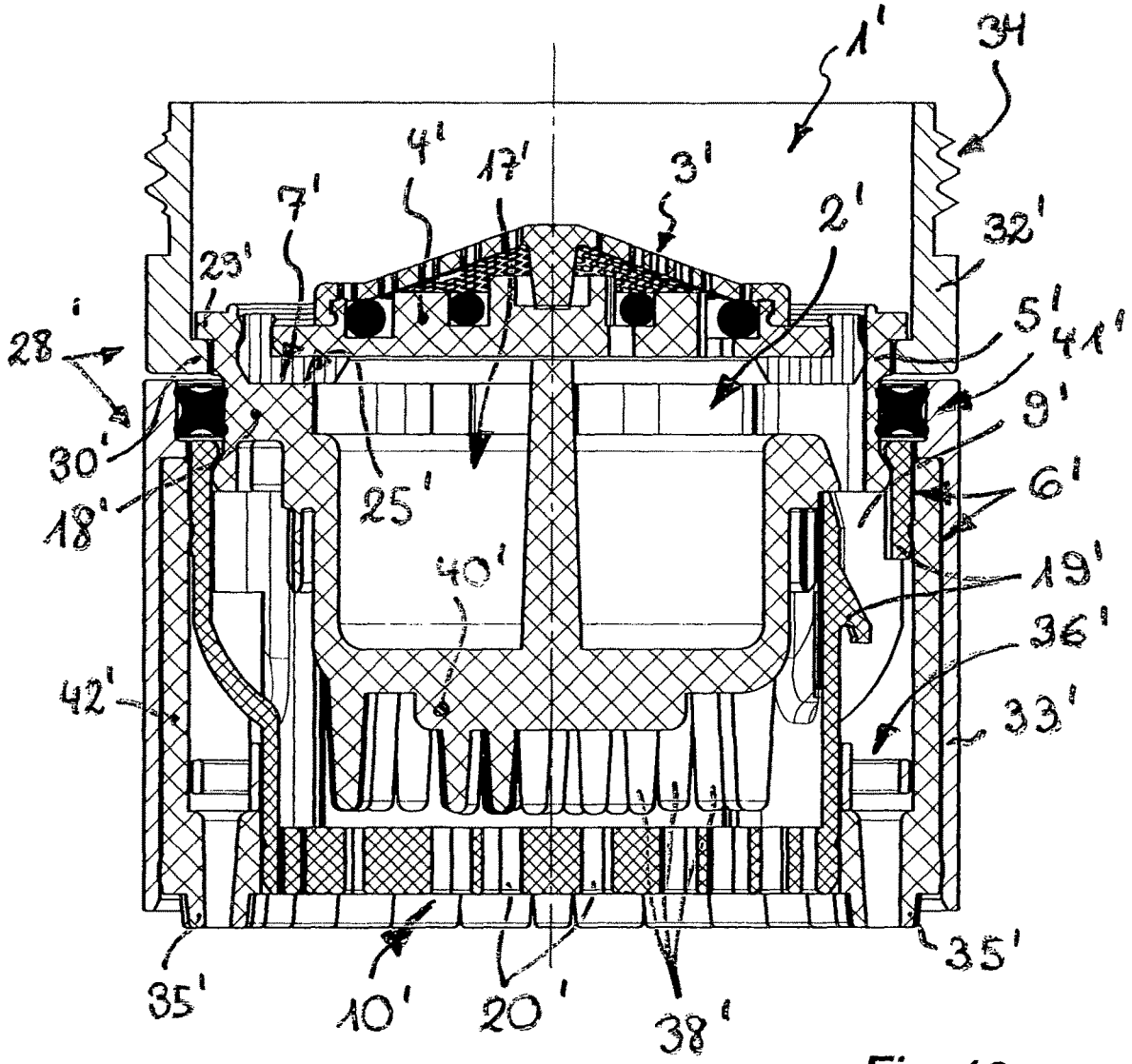
FIG. 16 shows a further embodiment, likewise illustrated in longitudinal section, of a sanitary insert unit which is mountable with the aid of an outlet mouthpiece on the water outlet of a sanitary water outlet fitting, wherein the longitudinal section is in this case angled in the region of the longitudinal central axis of the insert unit.
Figure 17:
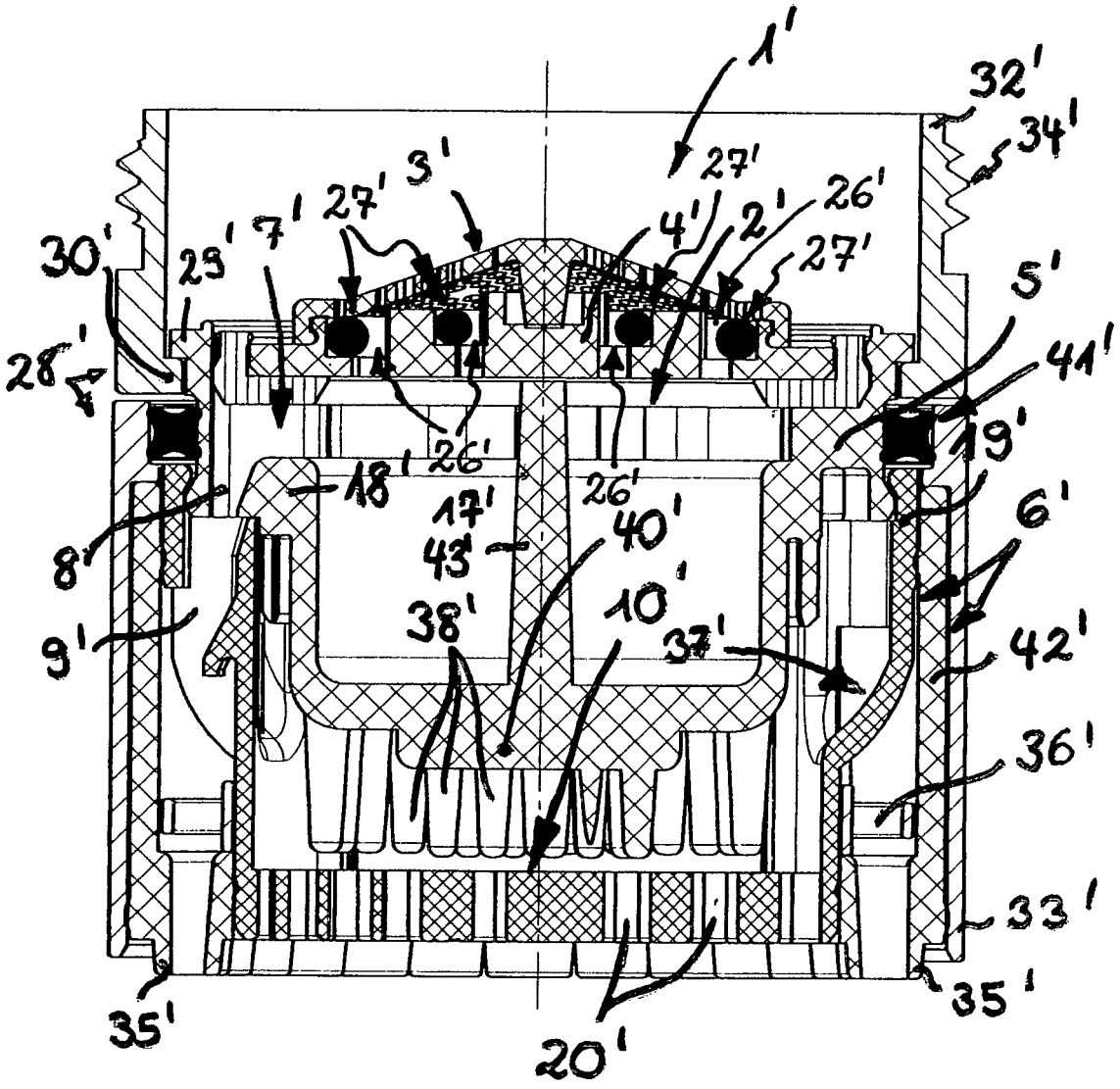
FIG. 17 shows the insert unit from FIG. 16 in a differently angled longitudinal section.
Figure 18:
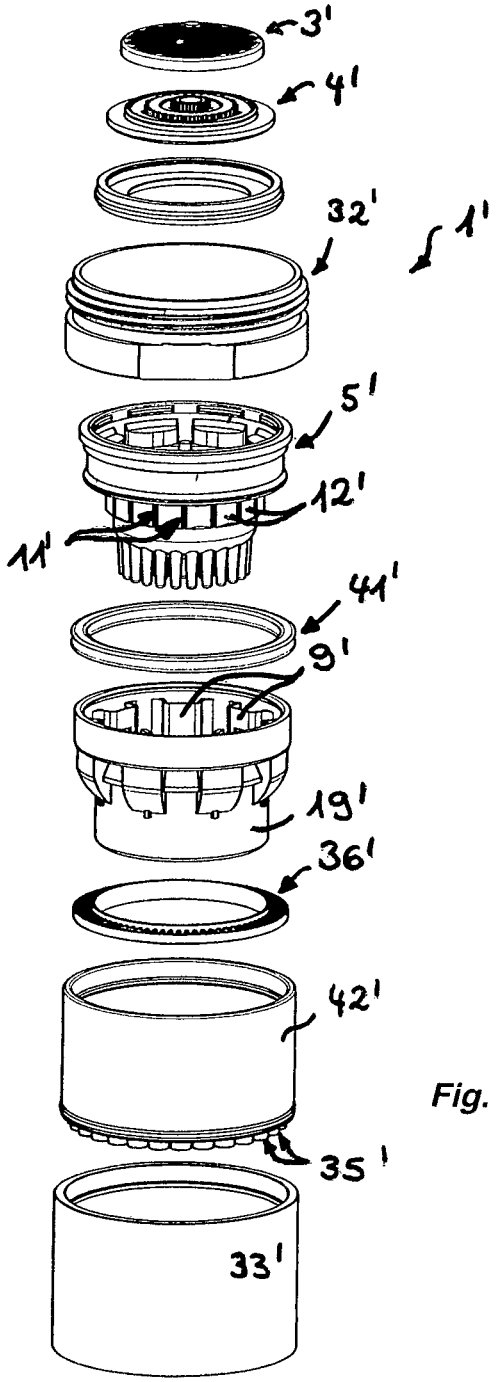
FIG. 18 shows the insert unit from FIGS. 16 and 17 in a perspective plan view of the inflow side of its exploded individual parts.
Figure 19:
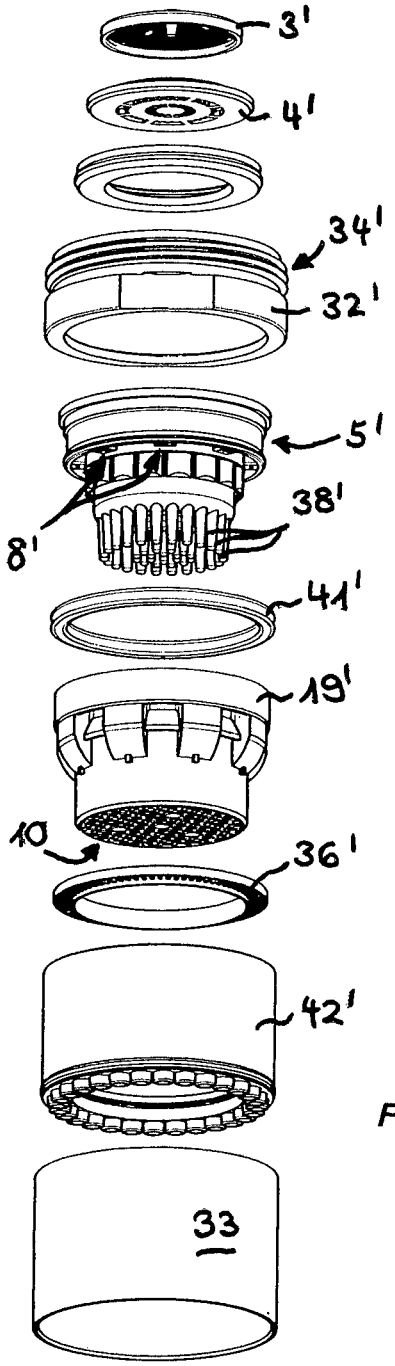
FIG. 19 shows the insert unit from FIGS. 16 to 18 in a perspective view from below of the outflow side of its exploded individual parts.
Figure 20:
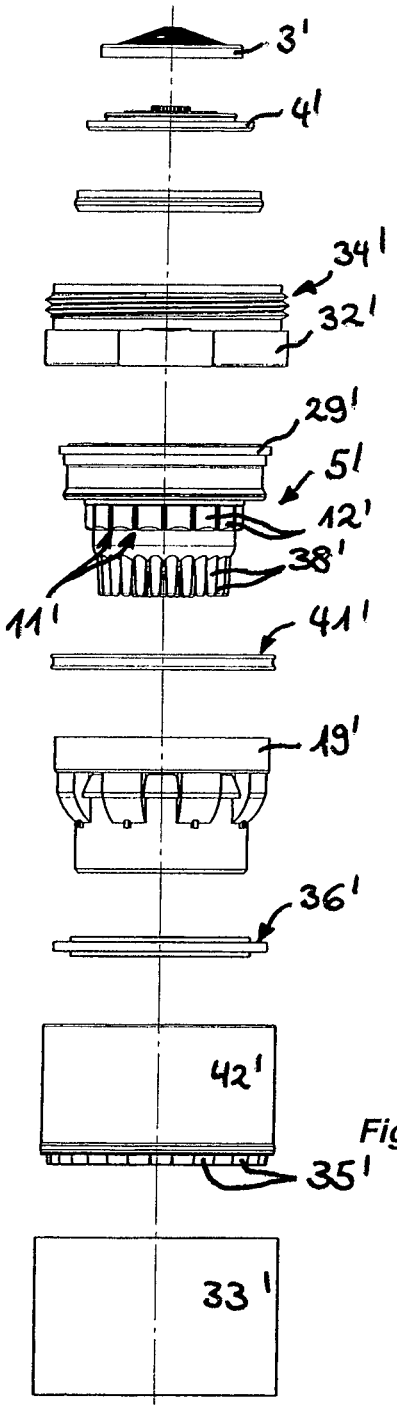
FIG. 20 shows the insert unit from FIGS. 16 to 19 in a side view of its exploded individual parts.
Figure 23:
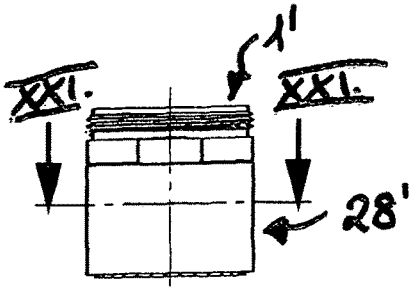
FIG. 23 shows the insert unit from FIGS. 16 to 22 in a simplified side view, with the section plane of the cross section from FIG. 21 being indicated.

In FIGS. 16 and 17, it can be seen that the first housing part of the jet regulator is inserted into the inflow-side end opening of the first portion 32' of the outlet mouthpiece 28' until the circumferential annular flange 29' which protrudes from the outer circumference of said first housing part comes to lie against an annular shoulder 30' in the sleeve interior of the first portion 32'. The first housing part 5' is engaged around by a sealing ring 41' which seals off any annular gap that remains between the outer circumference of the first housing part 5' and the outflow-side second portion 6'. The outer sleeve of the second housing part 6' is latched in the outflow-side second portion 33', wherein the outer sleeve 42' simultaneously also holds the internal sleeve 19' between itself and the first portion 32'. The jet splitter 7' has, at the inside on its pot bottom, a central support peg 43' which, by means of its peg end oriented counter to the flow direction, supports the flow rate regulator 4'.

LIST OF REFERENCE DESIGNATIONS

1, 1' Sanitary insert unit
2, 2' Jet regulator
3, 3' Attachment or filter screen
4, 4' Flow rate regulator
5, 5' Inflow-side first housing part
6, 6' Outflow-side second housing part
7, 7' Jet splitter
8, 8' Splitter openings
9, 9' Jet ducts
10, 10' Central outlet opening
11, 11' Latching indentation
12, 12' Latching cam
13, 13' Latching tooth
14, Flexible tongue
15, 15' Wall incision
16, 16' Wall incision
17, 17' Central first jet splitter subregion
18, 18' Second jet splitter subregion
19, 19' Internal sleeve
20, 20' Discharge openings
21, 21' Webs
22 Indentations
23 Protuberances
24 Insert part
25, 25' Support
26, 26' Annular gap
27, 27' Throttle body
28, 28' Outlet mouthpiece
29, 29' Annular flange
30, 30' Annular shoulder
31 Handling ring
32' Inflow-side portion
33' Outflow-side portion
34' External thread
35' Spray nozzles
36' Annular insert
37, 37' Deflecting slope
38' Pins
40' Central pot-bottom subregion
41' Sealing ring
42' External sleeve
43' Support peg
44' Flow divider
45' Pocket-like cutout
46' Duct-like discharge ducts
S1 Flow path as per FIGS. 2 and 4
S2 Flow path as per FIGS. 1 and 3

The invention claimed is:

1. A jet regulator (2, 2') which is switchable between at least two outlet jet patterns, comprising a jet regulator housing including at least two housing parts (5, 6; 5', 6') which are rotatable relative to one another and of which an inflow-side of a first of the at least two housing parts (5, 5') is mountable in a rotationally fixed manner on a water outlet of a sanitary outlet fitting and of which an outflow-side of a second of the at least two housing parts (6, 6'), at least at an outflow-side housing outer circumference thereof, is configured as a handle or is connected to a handle, the first housing part (5, 5') has a jet splitter (7, 7') having a plurality of splitter openings (8, 8'), mutually spaced-apart jet ducts (9, 9') provided on a housing inner circumference of the second housing part (6, 6'), individual jets coming from the splitter openings (8, 8') are adapted to be guided through the jet ducts (9, 9') and are adapted to be formed into an annularly circumferential outlet jet pattern in a first rotary position of the housing parts (5, 6; 5', 6'), and are adapted to be deflected in a housing interior of the jet regulator (2, 2') to a central outlet opening (10, 10') in the jet regulator housing in a second rotary position, a rotary latch having at least one latching tooth (13, 13') provided between the first and the second housing part (5, 6; 5', 6'), said latching tooth (13, 13') being integrally formed on a duct wall, facing the housing interior of the jet regulator housing, of at least one of the jet ducts (9, 9') and said latching tooth (13, 13') interacting with a latching profile which is arranged on a circumferential wall of the first housing part (5, 5'), wherein at least one subregion, bearing the latching tooth (13, 13'), of the duct wall of the at least one of the jet ducts (9) or at least a subregion of the duct wall, bearing the latching profile, of the first housing part (5') is configured as a flexible tongue (14, 14'), and a lattice or grid structure integrally formed on the outflow side of the second housing part (6, 6') that extends over the central outlet opening (10, 10'), the splitter openings (8, 8') of the jet splitter (7, 7') open into discharge ducts (46') of the jet splitter (7, 7') which are separated from one another in a circumferential direction by pocket-shaped cutouts (45') in an outflow side of the jet splitter (7, 7'), such that the discharge ducts protrude from the jet splitter.

2. The jet regulator as claimed in claim 1, wherein the at least one latching tooth (13, 13') comprises at least two latching teeth, at least two of the jet ducts (9, 9') are each provided with a latching tooth.

3. The jet regulator as claimed in claim 1, wherein the annularly circumferential outlet jet pattern is formed by individual jets that are arranged orbitally and emerge from the jet regulator (2') separately from one another.

4. The jet regulator as claimed in claim 1, wherein the annularly circumferential outlet jet pattern emerges from the jet regulator (2) as an annular wall.

5. The jet regulator as claimed in claim 1, wherein the flexible tongue (14) of the at least one jet duct (9) is separated on both sides from adjacent duct side walls by wall incisions (15, 16).

6. The jet regulator as claimed in claim 1, wherein the latching profile provided on the circumferential wall of the first housing part (5, 5') has latching cams (12, 12') which are arranged alongside one another in the circumferential direction and of which in each case two adjacent ones of the latching cams (12, 12') bound a latching indentation (11, 11') between one another.

7. The jet regulator as claimed in claim 6, wherein each said subregion, bearing in each case one of the latching cams (12'), of the wall is configured as a flexible tongue, and wall incisions (15', 16') are provided between adjacent flexible tongues in a region of each said latching indentation (11').

8. A jet regulator (2, 2') which is switchable between at least two outlet jet patterns, comprising a jet regulator housing including at least two housing parts (5, 6; 5', 6') which are rotatable relative to one another and of which an inflow-side of a first of the at least two housing parts (5, 5') is mountable in a rotationally fixed manner on a water outlet of a sanitary outlet fitting and of which an outflow-side of a second of the at least two housing parts (6, 6'), at least at an outflow-side housing outer circumference thereof, is configured as a handle or is connected to a handle, the first housing part (5, 5') has a jet splitter (7, 7') having a plurality of splitter openings (8, 8'), mutually spaced-apart jet ducts (9, 9') provided on a housing inner circumference of the second housing part (6, 6'), individual jets coming from the splitter openings (8, 8') are adapted to be guided through the jet ducts (9, 9') and are adapted to be formed into an annularly circumferential outlet jet pattern in a first rotary position of the housing parts (5, 6; 5', 6'), and are adapted to be deflected in a housing interior of the jet regulator (2, 2') to a central outlet opening (10, 10') in the jet regulator housing in a second rotary position, a rotary latch having at least one latching tooth (13, 13') provided between the first and the second housing part (5, 6; 5', 6'), said latching tooth (13, 13') being integrally formed on a duct wall, facing the housing interior of the jet regulator housing, of at least one of the jet ducts (9, 9') and said latching tooth (13, 13') interacting with a latching profile which is arranged on a circumferential wall of the first housing part (5, 5'), wherein at least one subregion, bearing the latching tooth (13, 13'), of the duct wall of the at least one of the jet ducts (9) or at least a subregion of the duct wall, bearing the latching profile, of the first housing part (5') is configured as a flexible tongue (14, 14'), and a lattice or grid structure integrally formed on the outflow side of the second housing part (6, 6') that extends over the central outlet opening (10, 10'), the splitter openings (8, 8') of the jet splitter (7, 7') open into discharge ducts (46') of the jet splitter (7, 7') which are separated from one another in a circumferential direction by pocket-shaped cutouts (45') in an outflow side of the jet splitter (7, 7'), wherein the latching profile provided on the circumferential wall of the first housing part (5, 5') has latching cams (12, 12') which are arranged alongside one another in the circumferential direction and of which in each case two adjacent ones of the latching cams (12, 12') bound a latching indentation (11, 11') between one another, wherein the latching profile is formed from mutually alternating ones of the latching cams (12, 12') and the latching indentations (11, 11') which are connected together via latching flanks, and a profile rounding is provided between in each case one said latching flank and an adjacent one of the latching cams (12, 12') or an adjacent one of the latching indentations (11, 11').

9. The jet regulator as claimed in claim 8, wherein radii of the profile roundings and of the at least one latching tooth (13, 13') approximately correspond to one another.

10. A jet regulator (2, 2') which is switchable between at least two outlet jet patterns and which comprises a jet regulator housing with at least two housing parts (5, 6; 5', 6') which are rotatable relative to one another and of which an inflow-side first one of the housing parts (5, 5') is mountable in a rotationally fixed manner on a water outlet of a sanitary outlet fitting and of which an outflow-side second one of the housing parts (6, 6'), at least at an outflow-side housing outer circumference thereof, is configured as a handle or is connected to a handle, the first housing part (5, 5') has a jet splitter (7, 7') having a plurality of splitter openings (8, 8'), mutually spaced-apart jet ducts (9, 9') provided on a housing inner circumference of the second housing part (6, 6'), individual jets coming from the splitter openings (8, 8') are adapted to be guided through the jet ducts (9, 9') and adapted to be formed into an annularly circumferential outlet jet pattern in a first rotary position of the housing parts (5, 6; 5', 6'), and are adapted to be deflected in a housing interior of the jet regulator (2, 2') to a central outlet opening (10, 10') in the jet regulator housing in a second rotary position, the jet splitter (7, 7') has two jet splitter subregions (17, 18), a central first one of the jet splitter subregions (17, 17') is configured as pot-shaped, the central first jet splitter subregion (17, 17') is connected to a second one of the jet splitter subregions (18, 18') that is configured as a circumferential annular flange or annular shoulder, and the splitter openings (8, 8') are provided in the second jet splitter subregion (18, 18'), and the pot-shaped jet splitter (7') has, on an outflow side at a pot bottom thereof, spaced-apart pins (38') or pegs which form pin flow obstructions.

11. The jet regulator as claimed in claim 10, wherein deflecting slopes (37, 37') are provided on an inner circumference of the second housing part (6, 6'), said deflecting slopes (37, 37') being adapted to deflect the individual jets formed in the splitter openings (8, 8') in a direction of the central outlet opening (10, 10') in at least the second rotary position of the housing parts (5, 6; 5', 6').

12. The jet regulator as claimed in claim 11, wherein the spaced-apart flow obstructions are provided on an outflow side of the deflecting slopes (37, 37').

13. The jet regulator as claimed in claim 10, wherein at least one of the pins (38') or pegs taper conically toward an outflow-side pin or peg end, or the pin or peg end of the pins (38') or pegs is rounded.

14. The jet regulator as claimed in claim 10, wherein at least one of a central pot-bottom subregion protrudes from the outflow side of the pot bottom of the pot-shaped jet splitter (7'), or the pot bottom of the pot-shaped jet splitter (7') is formed with steps at least on an outflow side thereof.

15. The jet regulator as claimed in claim 13, wherein the pin or peg ends of the pins (38') or pegs are arranged approximately in a plane.

16. The jet regulator as claimed in claim 10, further comprising spray nozzles (35') connected downstream of the jet ducts (9') in a direction of flow, and the spray nozzles (35') open out in an outlet-side subregion of the jet regulator housing.

17. The jet regulator as claimed in claim 16, further comprising at least one annular insert (36'), which has a lattice or grid structure, provided between the jet ducts (9, 9') and the spray nozzles (35').

18. The jet regulator as claimed in claim 17, wherein the lattice structure of the annular insert (36') is formed by webs which bound throughflow holes between one another.

19. The jet regulator as claimed in claim 16, wherein at least one internal subregion of the circumferential walls that enclose the spray nozzles (35') is directed obliquely outward.

20. The jet regulator as claimed in claim 19, wherein the splitter openings (8, 8') are arranged in a manner distributed regularly over the second jet splitter subregion (18, 18').

21. The jet regulator as claimed in claim 19, wherein the pot-shaped first jet splitter subregion (17, 17') is configured in a hole-free manner.

22. The jet regulator as claimed in claim 10, wherein the jet splitter (7, 7') is connected integrally to the inflow-side first housing part (5, 5').

23. The jet regulator as claimed in claim 10, wherein the second housing part (6, 6') is configured in a sleeve-shaped manner at least in an inflow-side subregion thereof.

24. The jet regulator as claimed in claim 10, wherein the first and the second housing part (5, 6; 5', 6') are connectable releasably together.

25. The jet regulator as claimed in claim 10, wherein the pot-shaped first jet splitter subregion (17, 17') protrudes into a sleeve interior of the second housing part (6, 6').

26. The jet regulator as claimed in claim 10, wherein an internal sleeve (19, 19') is provided in the second housing part (6, 6'), and an outlet end side of said internal sleeve (19, 19') forms the central outlet opening (10, 10').

27. The jet regulator as claimed in claim 26, wherein the internal sleeve (19) is integrally formed in the second housing part (6).

28. The jet regulator as claimed in claim 26, wherein the outlet end side, forming the central outlet opening (10, 10'), of the internal sleeve (19, 19') is configured as a lattice or grid structure which is formed by webs (21, 21') that intersect at intersecting points and enclose discharge openings (20, 20') between one another.

29. The jet regulator as claimed in claim 10, wherein the individual jets formed in the splitter openings (8, 8') are adapted to be guided against the external duct wall of the jet ducts (9, 9') in at least the first rotary position of the housing parts (5, 6; 5', 6'), and at least one of the duct walls of the splitter openings is oriented obliquely outward with respect to a jet regulator longitudinal axis.

30. The jet regulator as claimed in claim 26, wherein the jet ducts (9) are arranged in an annular gap between an outer circumference of the internal sleeve (19) and the housing inner circumference of the jet regulator housing.

31. The jet regulator as claimed in claim 10, wherein the jet ducts (9, 9') open out in an outlet-side subregion of the jet regulator housing, and said outlet-side subregion has a clear housing cross section that widens in an outlet direction.

32. The jet regulator as claimed in claim 31, wherein a profile is provided on an inner circumferential side in the outlet-side subregion of the jet regulator housing, said profile being formed by indentations and protuberances (22, 23) oriented in a direction of flow.

33. The jet regulator as claimed in claim 31, wherein the jet regulator housing has a separation edge on an inner circumference of said outlet-side subregion.

34. The jet regulator as claimed in claim 10, wherein the jet regulator (2, 2') is a constituent part of a sanitary insert unit (1, 1'), and a flow rate regulator (4, 4') or a throughflow throttle is connected upstream of the jet regulator (2, 2').

35. The jet regulator as claimed in claim 34, wherein the flow rate regulator (4, 4') or the throughflow throttle is insertable into the first housing part (5, 5') as far as a support (25, 25').

36. The jet regulator as claimed in claim 34, wherein an attachment screen or filter screen (3, 3') is connected upstream of the flow rate regulator (4, 4') or the throughflow throttle, said attachment screen or filter screen (3, 3') being fixable to the first housing part (5, 5').

37. The jet regulator as claimed in claim 11, wherein at least one flow divider (44') is provided on at least one of the deflecting slopes, said at least one flow divider (44') being adapted to divide the water flowing along the deflecting slope (37') into part-flows.

38. The jet regulator as claimed in claim 37, wherein the at least one flow divider (44') protrudes over the at least one deflecting slope (37').

* * * * *